US008056752B2

(12) United States Patent
Carnevali

(10) Patent No.: US 8,056,752 B2
(45) Date of Patent: Nov. 15, 2011

(54) DRIPLESS LID FOR BEVERAGE CONTAINER

(76) Inventor: Jeffrey D. Carnevali, Seattle, WA (US)

( * ) Notice: Subject to any disclaimer, the term of this patent is extended or adjusted under 35 U.S.C. 154(b) by 577 days.

(21) Appl. No.: 11/900,511

(22) Filed: Sep. 12, 2007

(65) Prior Publication Data

US 2009/0065518 A1 Mar. 12, 2009

(51) Int. Cl.
*B65D 51/16* (2006.01)

(52) U.S. Cl. ..... 220/372

(58) Field of Classification Search ..... 215/200; *B65D 51/16*

See application file for complete search history.

(56) References Cited

U.S. PATENT DOCUMENTS 1,137,462 A * 4/1915 Clark ..... 210/469
2,546,874 A 3/1951 Siegrist
3,174,661 A 3/1965 Speicher
3,460,310 A 8/1969 Adcock et al.
3,815,314 A 6/1974 Pollock et al.
3,938,690 A 2/1976 Butler
4,057,167 A 11/1977 Lee
4,059,201 A 11/1977 Foster
4,090,660 A 5/1978 Schram et al.
4,098,177 A 7/1978 Olney et al.
4,170,724 A 10/1979 Waterbury
4,186,842 A 2/1980 Albert
4,228,633 A 10/1980 Corbic
4,331,255 A * 5/1982 Fournier ..... 220/257.2
4,336,038 A 6/1982 Schultheiss et al.
4,350,260 A 9/1982 Prueher
4,441,624 A 4/1984 Sokolowski
4,460,103 A 7/1984 Rama et al.
4,473,167 A 9/1984 Bailey
4,484,687 A 11/1984 Bullock, III
4,537,318 A 8/1985 Montgomery
4,573,631 A 3/1986 Reeves
4,589,569 A 5/1986 Clements
4,619,372 A * 10/1986 McFarland ..... 220/713
4,719,740 A 1/1988 Gach
4,913,305 A 4/1990 Hanafusa et al.
4,917,942 A 4/1990 Winters
4,925,051 A * 5/1990 Herbst ..... 220/713
4,934,558 A 6/1990 Vargas
5,044,531 A 9/1991 Rhodes
5,065,880 A 11/1991 Horner
5,147,065 A 9/1992 Rush et al.
5,253,781 A 10/1993 Van Melle et al.
5,363,983 A * 11/1994 Proshan ..... 220/717
5,397,023 A 3/1995 Toczek et al.
5,398,843 A 3/1995 Warden et al.
(Continued)

*Primary Examiner* — Mickey Yu
*Assistant Examiner* — Robert J Hicks
(74) *Attorney, Agent, or Firm* — Charles J. Rupnick Attorney at Law

(57) ABSTRACT

A disposable lid for mounting upon the substantially circular lip of a personal beverage container and a method for making the same, the lid having an annular mounting portion for anchoring upon the circular cup lip; a top plate portion coupled to the annular mounting portion; a drink-through opening within the top plate portion and adjacent to an outer portion thereof adjacent to the annular mounting portion and enabling drinking from the cup without removal of the lid and permitting the lips of a user drinking from the cup to substantially encompass the drink-through opening, the drink-through opening further including a liquid permeable membrane formed of a first plurality of perforations; and a vent opening within the top plate portion spaced away from the drink-through opening, the vent opening further including an air permeable membrane formed of a second plurality of perforations.

50 Claims, 9 Drawing Sheets

U.S. PATENT DOCUMENTS 5,490,609 A 2/1996 Lane et al.
5,509,568 A 4/1996 Warden et al.
5,542,670 A 8/1996 Morano
5,588,552 A 12/1996 Johnson
5,613,619 A 3/1997 Van Melle
5,699,927 A 12/1997 Lane et al.
D400,397 S * 11/1998 Stephan ..... D7/510
5,839,601 A 11/1998 Van Melle
5,890,621 A 4/1999 Bachman et al.
5,894,952 A 4/1999 Mendenhall et al.
5,911,331 A 6/1999 Boller
5,934,493 A 8/1999 Han
5,947,323 A 9/1999 Freek et al.
5,979,647 A 11/1999 Han
6,076,450 A * 6/2000 DiGiorgio, Jr. ..... 99/298
6,089,397 A 7/2000 Van Melle
6,136,409 A 10/2000 Kondo et al.
RE37,016 E 1/2001 Morano
6,169,045 B1 1/2001 Pike et al.
6,176,420 B1 1/2001 Sarson et al.
6,224,768 B1 5/2001 Navarre et al.
6,260,727 B1 7/2001 Durdon
6,354,454 B1 3/2002 Wong
6,419,112 B1 7/2002 Bruce et al.
6,422,415 B1 7/2002 Manganiello
6,431,390 B1 * 8/2002 Waller ..... 220/713
6,457,613 B1 10/2002 Patterson
6,468,651 B2 10/2002 Aikawa et al.
6,578,726 B1 * 6/2003 Schaefer ..... 220/253
6,592,504 B2 7/2003 Sarson et al.
6,612,456 B1 9/2003 Hundley et al.
6,644,490 B2 11/2003 Clarke
6,752,287 B1 6/2004 Lin
6,758,390 B2 7/2004 Sarson et al.
6,824,003 B1 11/2004 Wong
6,889,859 B1 * 5/2005 Leon ..... 220/254.3
6,889,860 B2 5/2005 Mazzarolo
6,929,143 B2 8/2005 Mazzarolo
7,134,569 B2 11/2006 Freek et al.
7,134,570 B1 11/2006 Heath et al.
7,175,042 B2 2/2007 Durdon
7,246,716 B2 7/2007 Durdon
2002/0003145 A1 * 1/2002 Milan ..... 220/713
2002/0052286 A1 5/2002 Sarson et al.
2003/0024930 A1 * 2/2003 Smith et al. ..... 220/254.1
2003/0102312 A1 6/2003 Horner
2004/0011862 A1 1/2004 Sarson et al.
2004/0045922 A1 * 3/2004 Holley, Jr. ..... 215/11.4
2004/0144744 A1 * 7/2004 Holley, Jr. ..... 215/11.1
2004/0178199 A1 9/2004 Stroup
2004/0178207 A1 9/2004 Kim
2004/0182862 A1 9/2004 Scott
2004/0211823 A1 10/2004 Sarson et al.
2005/0092749 A1 5/2005 Durdon
2005/0173443 A1 8/2005 Crudgington, Jr.
2006/0021524 A1 2/2006 Liu
2006/0226147 A1 10/2006 Phillips
2006/0243734 A1 * 11/2006 Tedford ..... 220/780
2006/0255037 A1 11/2006 Hollis et al.
2006/0255038 A1 11/2006 Hollis et al.
2007/0095832 A1 5/2007 Hollis et al.
2008/0035652 A1 * 2/2008 Lusareta ..... 220/713

* cited by examiner

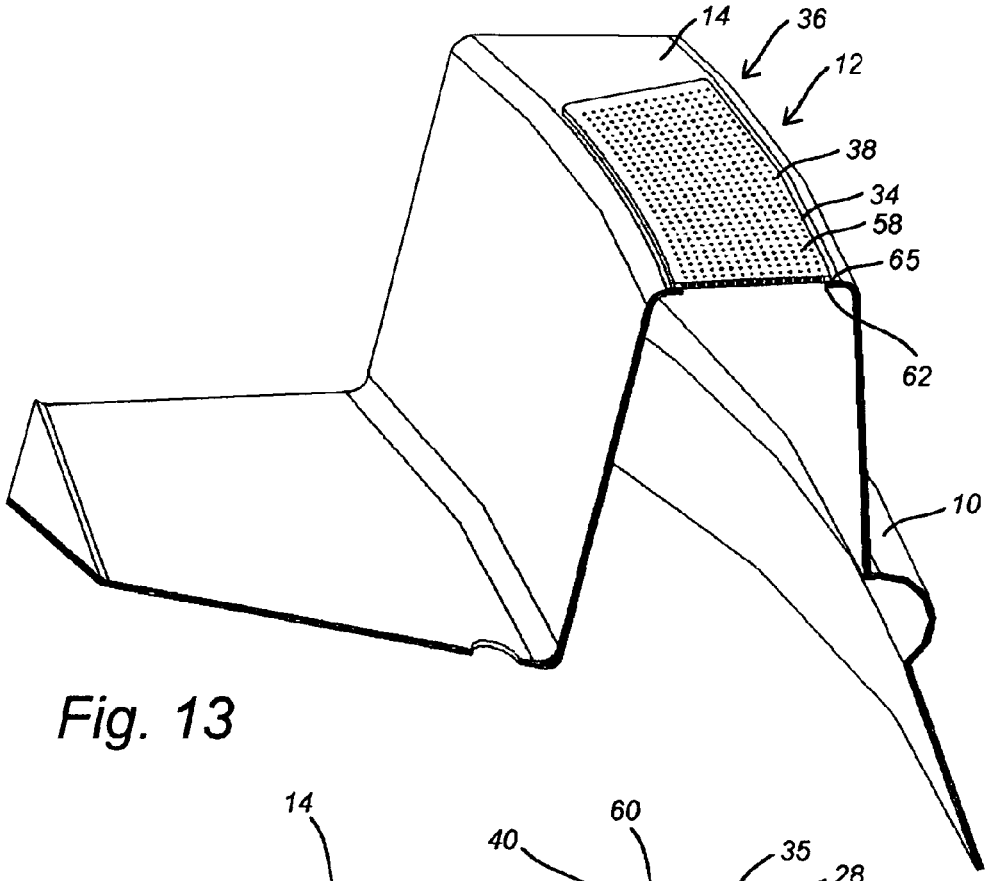
Fig. 13
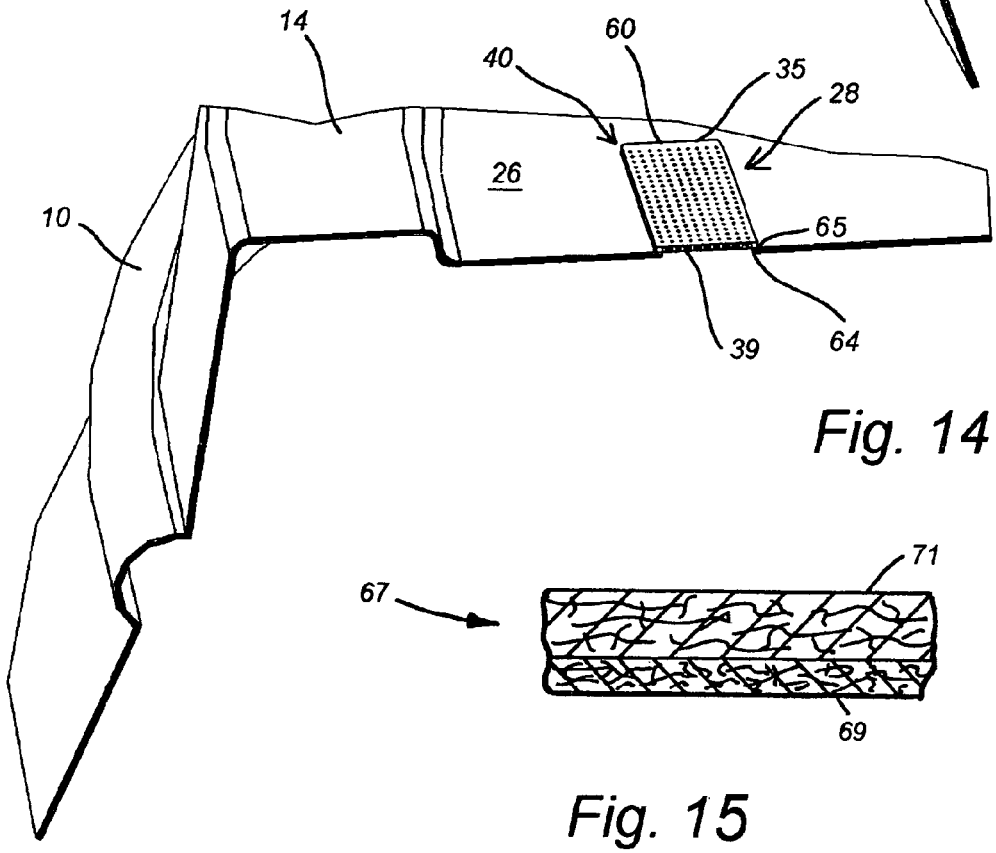
Fig. 14
Fig. 15

DRIPLESS LID FOR BEVERAGE CONTAINER

FIELD OF THE INVENTION

The present invention relates generally to disposable lids for personal beverage cups and other personal beverage containers, and in particular to disposable lids which may be placed over the lip of a beverage cup or other container and provide a substantially non-drip drink-through opening for easy drinking access to the beverage.

BACKGROUND OF THE INVENTION

Disposable splash resistant cup lids with a drink-through opening that affix to disposable beverage cups of both dome and non-dome types are generally well-known for a wide variety of carry-out hot and cold beverages. U.S. Pat. No. 5,065,880, Splash Resistant Cup Lid, to Horner, which is incorporated in its entirety herein by reference, discloses a splash resistant cup lid designed to prevent spills and splashes caused by beverage sloshing. Horner recognizes the dynamics of sloshing liquids and the benefit of vertical drink-through openings. Horner describes a lid having an opening that comes generally sealed by means of a raised canopy with drink-through slits that remain closed until the canopy is depressed into the lid causing the slits to open and becoming somewhat vertically positioned. Horner teaches that sloshed liquids have a vertical component to their motion with respect to the cup lid, and by creating vertical rather than horizontal drinking openings, much of the fluid will be deflected back into the cup.

In the alternative, the many benefits of dome lids have been described in detail within prior art and are well-known to the general public.

Generally, disposable dome lids are designed to grip and seal upon an outwardly projecting peripheral bead formed for this purpose around a lip of disposable cups. Two methods for attaching disposable dome lids to cups have been described in prior art and are believed to be commonly used in practice. One method provides an annular outwardly projecting groove that snaps into place when pushed over the peripheral bead around the lip of the cup. The annular groove is formed in an annular apron adjacent to a base of the lid. Because of the flexibility of the plastic material used in the manufacture of disposable lids, the annular apron containing the groove is able to momentarily expand while sliding over the bead surrounding the lip of the cup. When in place the annular groove grips the annular bead thereby holding and sealing the lid to the cup. Rather than having an outwardly projecting groove, many disposable dome lids employ a second method of attachment having an inverted annular groove surrounding the lid's base and forming what is referred to as a "plug fit". When attached, the lip of the cup extends into the inverted groove which applies pressure not only to the cup lip's outer edge but to the inner edge as well. The plug fit method, by applying pressure to both sides of the cup's edge, eliminates the possibility of the cup's lip caving inward causing the seal to break. For this reason, the plug fit can be applied to less expensive cups having a weaker sidewall.

As discussed by Cleveland Benedict Crudgington, Jr. in published United States Patent Application 20050173443, Disposable Drinking Cup Lid, filed Jan. 31, 2005, which is incorporated in its entirety herein by reference, regardless of the means for attaching to a cup, disposable drink-through dome lids presented in prior art have been grouped into three distinct types: those that provide a comparatively larger drink-through opening by means of a tear-back flap; those that provide a small drink-through opening positioned within a reservoir having a sidewall that aligns with the user's mouth; and those that provide a drink-through opening by means of a small preformed usually elongated opening intended to be enclosed by the user's mouth during consumption.

Each of these three types of drink-through lids has inherent advantages and disadvantages. The fold or tear-back flap permits the beverage to be mostly sealed within the cup while being transported prior to consumption. Additionally, the beverage is consumed in a manner most similar to drinking from a conventional drinking cup. However, once the flap has been opened, the cup cannot be easily moved about without risk of spilling its contents. Since no provision is made for retaining the beverage that sloshes out through the opening, this type of disposable lid is not suitable for users wishing to consume their carry-out beverage while traveling. The second type of disposable drink-through lid addresses this problem by providing a reservoir which surrounds the drink-through opening. Beverage that sloshes out through the opening, is contained within the reservoir and eventually drains back into the cup. This feature arrests most spills that might otherwise occur while the cup is vertically placed within a moving vehicle. However, this lid is vulnerable to spills from the moment the beverage passes through the opening and prior to entering the user's mouth. Thus, if the user were to be jostled during that time, as when riding over a bump while sipping the beverage, the exposed contents would likely be ejected into the air resulting in a spill. For this reason, although this type of lid is improved for travel, neither are preferable for beverage consumption in a moving vehicle.

With many consumers on the go, carry-out beverages are more often than not intended to be consumed in moving vehicles. Disposable lids, of the kind that provide a seal between the user's mouth and the drink-through opening, have proven best suited for prevention of spills during consumption while traveling. This is based on the wide-spread acceptance of this type of lid used by take-out establishments. However, there are limitations with this type of drink-through dome lid, particularly in regard to consumption of beverages within moving vehicles. Of greatest concern is the safety to the user behind the steering wheel. Besides the annoyance of soiling one's clothes, the sudden distraction resulting from a spill could result in an automobile accident.

Dome lids that provide means for a seal between the user's mouth and the drink-through opening have a number of concerns, the most important being that the beverage is vulnerable to spilling out through the drink-through opening when a relatively full cup is being jostled about. A second smaller drain hole is typically placed within the deepest point of a recess provided for the user's upper lip directly behind the drink-through opening so that spilled liquid caught in the recess can drain back into the cup. Also, a third equally small hole is recommended to alleviate the vacuum left by the discharging liquid, but this third vent hole provides another source for accidental spillage. It should be noted that other patents in related art have described this type of dome lid as having another inherent detriment. They are referring to the need to suck the liquid through the small drink-through opening in order to obtain the desired volume of beverage. However, the widespread acceptance of this type of lid would suggest that the need to suck the beverage from the container is not viewed by the user as an irritant nor a detriment.

Published United States Patent Application 20050173443, which is incorporated in its entirety herein by reference, also provides a description of the prior art. Of the references described in published United States Patent Application 20050173443, Clements and Clarke provide certain basic teachings of the features of disposable drink-through dome lids most pertinent to the present invention, namely those having a drink-through opening that is intended to be fully enclosed by the user's mouth during consumption of the beverage contained therein.

As described in published United States Patent Application 20050173443, U.S. Pat. No. 4,589,569 to Clements, which is incorporated in its entirety herein by reference, discloses a dome lid which is placed over the lip of a beverage cup, and which extends above the top of the cup so as to provide additional volume. A punched drinking hole is located in an elevated annular ridge formed at the top of the cup lid. Even though elevated above the cup's lip, the drink-through opening may not preclude spillage due to jostling of the cup. Two other openings are described by Clements, one for draining spilled liquid and another for venting purposes. The introduction of these openings as taught by Clements introduces additional opportunities for spillage. Clements further describes a recess behind the drink-through opening intended for accommodating the user's upper lip, thereby forming an annular ridge about the drink-through opening. This ridge is intended to be sealed by the user's upper and lower lips, yet Clements fails to address the means by which the user's upper and lower lips would best form a seal about the drink-through opening.

As described in published United States Patent Application 20050173443, U.S. Pat. No. 6,644,490 to Clarke, which is incorporated in its entirety herein by reference, teaches a dome lid as taught by Clements with the introduction of a press-out tab formed outside the annular periphery of the lid during manufacturing. Clarke discloses means to prevent accidental spillage by providing a method to plug the drink-through opening during times that the beverage is not being consumed. While this teaching provides novel means for sealing the drink-through opening, the tab must be repeatedly engaged and disengaged with every sip. Additionally, the procedure cannot be easily accomplished without the use of both hands, namely one hand to hold the cup while the other operates the tab. Furthermore, the addition of a tab suspended to one side of the lid may prove annoying to the immobile user who has no need for this feature.

As described in published United States Patent Application 20050173443, U.S. Pat. No. 5,253,781, Disposable Dome Lid For Drinking Cups, to Van Melle, et al., which is incorporated in its entirety herein by reference, also provides basic teachings that have relevance to the present invention. As described in published United States Patent Application 20050173443, Van Melle discloses a dome lid with a raised volume-extending section and a drink-through spout above the upper surface of the volume-extending section. Van Melle attempts to overcome the disadvantages of prior art particularly in consideration of the accidental spillage of carry-out beverages in moving vehicles. Van Melle teaches spills due to sloshing are further reduced by elevating the drink-through opening above the volume-extending section. Van Melle teaches that a generally rounded spout is more adaptable to the natural shape of the user's lips, therefore enabling the user to generate a liquid-tight seal with less effort.

Thus, despite some improvements to drink-through lids, limitations still exist that result in spillage from sloshing and contact between the lid and the user's mouth. Other limitations include a proliferation of accidental spills. Prevention of vehicle accidents is of paramount importance and presents a safety concern for the carry-out industry. But particularly annoying is the more frequent occurrence of spills resulting in the soiling of business attire while commuting to work or the soiling of evening attire while riding to an important social outing.

SUMMARY OF THE INVENTION

The present invention is a disposable lid for mounting upon the substantially circular lip of a personal beverage container.

According to one aspect of the invention the novel cup lid includes an annular mounting portion comprising means for anchoring upon the circular cup lip. A top plate portion is coupled to the annular mounting portion. A drink-through opening is formed within the top plate portion and adjacent to an outer portion thereof adjacent to the annular mounting portion and enabling drinking from the cup without removal of the lid and permitting the lips of a user drinking from the cup to substantially encompass the drink-through opening, the drink-through opening includes a porous liquid-permeable membrane formed, by example and without limitation, of a first plurality of perforations. A vent opening is formed within the top plate portion spaced away from the drink-through opening, the vent opening includes another permeable membrane formed, by example and without limitation, of a second plurality of perforations. The first and second permeable membranes are optionally configured with perforations of substantially the same porosity. Else, the perforations in the second membrane of the vent opening are gas permeable while being substantially impermeable to liquids.

According to another aspect of the novel cup lid, the first plurality of perforations of the drink-through opening further includes a plurality of substantially pin prick sized perforations.

According to another aspect of the novel cup lid, the first plurality of pin prick sized perforations of the drink-through opening are further formed as a plurality of aperture having an average throughput area substantially in the range of about 0.05 or 0.06 square millimeters up to about 0.12 square millimeters.

According to another aspect of the novel cup lid, the first plurality of pin prick sized perforations of the drink-through opening are further formed of a plurality of aperture having an average throughput area substantially in the range of about 0.08 to about 0.10 square millimeters.

According to another aspect of the novel cup lid, the second plurality of perforations of the vent opening are further formed as a plurality of elongated narrow slit perforations.

According to another aspect of the novel cup lid, the porous permeable membrane of the drink-through opening is further formed as a portion of self-supporting mesh material.

According to another aspect of the novel cup lid, the porous permeable membrane of the drink-through opening is further formed as a discrete liquid permeable membrane coupled to an aperture formed through the lid body.

According to another aspect of the novel cup lid, the porous permeable membrane of the drink-through opening is further formed as a surface that is substantially flush with a surrounding portion of the top plate portion; and the porous permeable membrane of the vent opening is further formed as a surface that is substantially flush with a surrounding portion of the top plate portion.

According to another aspect of the novel cup lid, the novel cup lid further includes an annular outer sidewall portion sloping upwardly and radially inwardly from the annular mounting portion and which is coupled to the top plate portion.

According to another aspect of the novel cup lid, the novel cup lid also includes an annular outer sidewall portion sloping upwardly and radially inwardly from the annular mounting portion; and the top plate portion further includes: an annular top wall portion formed adjacent to a top of the outer sidewall portion spaced above the annular mounting portion, an annular inner sidewall portion projected downwardly of the annular top wall portion, an inner top plate portion being formed within the annular inner sidewall portion and spaced away from the annular top wall portion; a recessed portion within the inner top plate portion, the recessed portion being further formed of an arcuate sidewall portion adjacent to the drink-through opening and an interior side wall spaced away from the drink-through opening and terminating in the inner top plate portion. A drain hole is also formed in the recessed portion and spaced away from the inner top plate portion.

Other aspects of the invention are detailed herein, including a method for forming a novel disposable cup lid for mounting upon the substantially circular lip of a personal beverage container. According to one aspect of the novel cup lid, the method for forming a novel disposable cup lid includes: in a plastic material, forming a thin top plate portion; in the plastic material, forming a thin annular mounting portion coupled to the top plate portion and further providing means for anchoring upon the circular cup lip; in the plastic material, forming a drink-through opening within the top plate portion and adjacent to an outer portion thereof adjacent to the annular mounting portion, the forming the drink-through opening further including forming a first liquid permeable membrane formed of, by example and without limitation, a first plurality of perforations; and in the plastic material, forming a vent opening within the top plate portion spaced away from the drink-through opening, the forming the vent opening further comprising forming a second gas permeable membrane formed of, by example and without limitation, a second plurality of perforations.

According to another aspect of the novel cup lid, the method for forming the first plurality of perforations of the drink-through opening of the novel disposable cup lid further includes forming the first plurality of perforations as a plurality of pin prick sized perforations.

According to another aspect of the novel cup lid, the method for forming the first plurality of perforations of the drink-through opening of the novel disposable cup lid as a plurality of pin prick sized perforations further includes forming the first plurality of perforations having an average throughput area substantially in the range of about 0.05 to no larger than about 0.12 square millimeters.

According to another aspect of the novel cup lid, the method for forming the first plurality of perforations of the drink-through opening of the novel disposable cup lid further includes sizing the first plurality of perforations as a function of at least one of a range of viscosity and a range of surface tension of a water-based liquid intended to fill the cup in such manner as to produce a throttle effect on the liquid in the cup.

According to another aspect of the novel cup lid, the method for forming the first and second pluralities of perforations of the novel disposable cup lid further includes forming each of the first and second pluralities of perforations having a substantially identical average range of pore sizes.

According to another aspect of the novel cup lid, the method for forming a first plurality of perforations of the novel disposable cup lid further includes forming the first plurality of perforations having a first average range of pore sizes, and the forming a second plurality of perforations of the novel disposable cup lid further includes forming the second plurality of perforations having a second average range of pore sizes different from the first average range of pore sizes.

According to another aspect of the novel cup lid, the method for forming the first and second permeable membranes of the novel disposable cup lid further includes forming the first and second permeable membranes substantially flush with an outer surface of the top plate portion.

According to another aspect of the method for forming the novel cup lid, the method further includes, in the plastic material, forming a thin annular outer sidewall portion sloping upwardly and radially inwardly from the annular mounting portion and being coupled to the top plate portion.

According to another aspect of the novel cup lid, the method for forming the top plate portion of the novel disposable cup lid further includes, in the plastic material, forming an annular top wall portion adjacent to a top of the outer sidewall portion spaced above the annular mounting portion; forming an annular inner sidewall portion projected downwardly of the annular top wall portion; forming an inner top plate portion within the annular inner sidewall portion and spaced away from the annular top wall portion; forming a recessed portion within the inner top plate portion, forming the recessed portion further comprising forming an arcuate sidewall portion adjacent to the drink-through opening and an interior side wall spaced away from the drink-through opening and terminating in the inner top plate portion; and forming a drain hole in the recessed portion and spaced away from the inner top plate portion.

According to another aspect of the novel cup lid, the method for forming the first liquid permeable membrane of the drink-through opening further includes forming a plurality of elongated narrow slit perforations.

According to another aspect of the novel cup lid, the method for forming the first liquid permeable membrane of the drink-through opening further includes forming a portion of substantially self-supporting mesh material.

According to still another aspect of the novel cup lid, the method for forming the first liquid permeable membrane of the drink-through opening further includes forming a discrete liquid permeable membrane and sealing it to an aperture formed through the top plate portion.

Still other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIGS. 13 and 14 are respective close-up partial section views of the novel disposable cup closure more clearly showing the drink opening being configured having the water-based liquid permeable membrane installed therein, and the vent also being configured having either the air or water-based liquid permeable membrane installed therein;

FIG. 15 illustrates by example and without limitation one example of a microporous mesh material that may be useful as one or both of the preformed liquid-permeable and air-permeable membranes;

DETAILED DESCRIPTION OF PREFERRED EMBODIMENT

In the Figures, like numerals indicate like elements.

As discussed herein and in published United States Patent Application 20050173443, which is incorporated in its entirety herein by reference, both dome and non-dome type disposable splash resistant cup lids have been described in detail within prior art and are well-known to the general public. Dome type lids are disclosed by example and without limitation in published United States Patent Application 20050173443, and non-dome type lids are described by example and without limitation in U.S. Pat. No. 5,065,880 to Horner, which is incorporated in its entirety herein by reference.

The present invention is described by example and without limitation with reference to dome type disposable splash resistant cup lids, yet it is not the intent of the examples contained herein to preclude non-dome type lids over dome type lids since all embodiments disclosed herein are applicable to either. The present invention recognizes that both dome and non-dome type lids are commonly and successfully used commercially. Therefore, both types of lids are contemplated and may be substituted without deviating from the scope and intent of the present invention.

As also discussed herein and in published United States Patent Application 20050173443, two methods for attaching disposable dome lids to the outwardly projecting peripheral bead formed on cups are believed to be commonly used in practice. One method of attachment provides an outwardly projecting annular apron adjacent to a base of the lid that snaps into place when pushed over the peripheral bead around the lip of the cup. The second method of attachment, particularly suited for less expensive cups having a weaker sidewall, provides instead what is referred to as a "plug fit" by an inverted annular groove surrounding the lid's base and into which the lip of the cup extends so that pressure is applied not only to the cup lip's outer edge but to the inner edge as well and eliminates the cup's lip caving inward causing the seal to break.

The present invention is described by example and without limitation with reference to the first method of attachment for illustration purposes, yet it is not the intent of the examples contained herein to preclude one method over the other since all embodiments disclosed herein are applicable to either. The present invention recognizes that both methods are commonly and successfully used commercially. Therefore, both method of attachment are contemplated and may be substituted without deviating from the scope and intent of the present invention.

Figure 1:
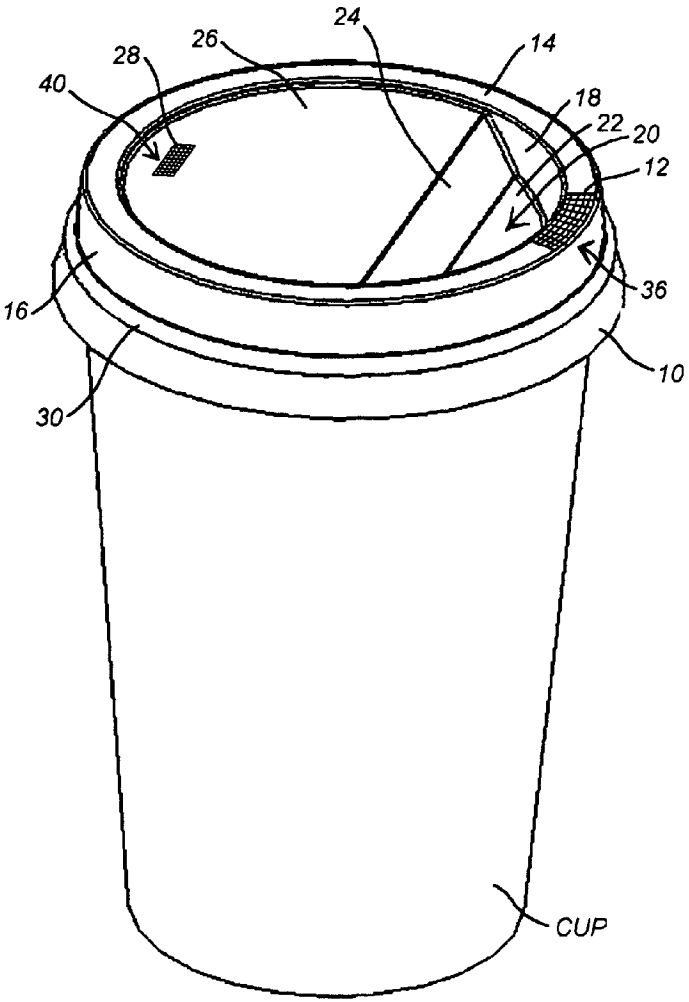
FIG. 1 is a pictorial side view of the present invention illustrated by example and without limitation as a novel disposable splash resistant dome type cup closure with a drink-through opening and being affixed to a beverage cup.

FIG. 1 is a pictorial side view of the present invention illustrated by example and without limitation as a drink-through closure 10 for a personal beverage container. In FIG. 1, the drink-through closure 10 is illustrated by example and without limitation as a disposable splash resistant dome type cup lid with a drink-through opening 12 affixed to a personal beverage container. Here, the personal beverage container is, by example and without limitation, a disposable personal beverage cup of the type described in the prior art. However, the present cup lid 10 is not intended to be limited to a disposable beverage cup; rather, the present cup lid 10 is effectively operable with any suitable personal beverage container, including but not limited to nondisposable drinking cups, bottle-type beverage containers, and can-type beverage containers.

For disposable lids 10 of the drink-through dome type, lid 10 forms a substantially planar annular top wall 14 bounded on its outer perimeter by an annular outer sidewall 16 sloping downwardly and outwardly, and on its inner perimeter by an annular inner sidewall 18 sloping downwardly and inwardly, with both perimeters being substantially concentric to one another. A primary recess 20 is bounded by the arcuate portion of annular inner sidewall 18 and further defined by two substantially planar surfaces 22 and 24, with a bottom wall 22 gently sloping upwardly and inwardly from the arcuate portion of annular interior sidewall 18 and terminating at a interior sidewall 24. Interior sidewall 24 continues to slope upwardly and inwardly at a substantially steeper angle than bottom wall 22, where it terminates at a substantially planar inner top plate 26 within the downwardly and inwardly sloping annular inner sidewall 18. In the preferred configuration, inner top plate 26 is recessed slightly below annular top wall 14 with both being generally planar and parallel to one another. A vent 28 is positioned within inner top plate 26. Vent 28 is positioned to reliably vent air into the cup during beverage consumption.

As taught by Clements, primary recess 20 accommodates the upper lip of the user by deepening annular inner sidewall 18 at a drink-through opening 12. The lower lip of the user is also accommodated by sufficiently raising outer sidewall 16 so the user's lower lip generally clears a mounting portion 30 formed at or near the base of outer sidewall 16 in order to affix the lid to a drinking cup. The mounting portion 30 is illustrated here by example and without limitation as having the first non-plug type method of attachment as described herein and in the prior art. The mounting portion 30 illustrated here thus provides by example and without limitation an outwardly projecting annular apron adjacent to a base of the lid that snaps into place when pushed over the peripheral bead around the lip of the cup. However, the mounting portion 30 is alternatively configured as providing the second "plug fit" method of attachment, which provides instead what is referred to as a by an inverted annular groove surrounding the lid's base and into which the lip of the cup extends so that pressure is applied not only to the cup lip's outer edge but to the inner edge as well and eliminates the cup's lip caving inward causing the seal to break and may be substituted without deviating from the scope and intent of the present invention.

Figure 2:
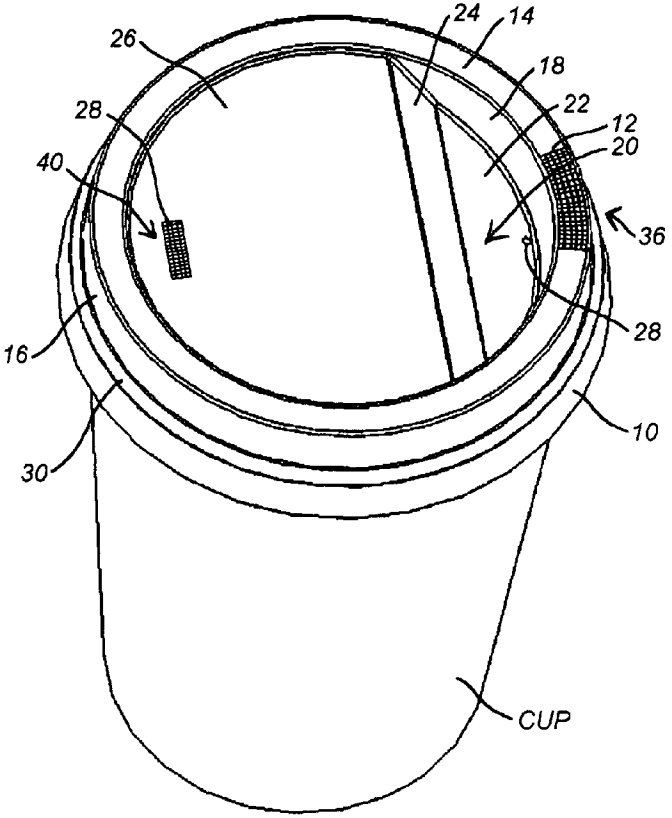
FIG. 2 is a pictorial top view of the present invention illustrated by example and without limitation as a novel disposable splash resistant dome type cup closure with a drink-through opening and being affixed to a beverage cup.

As shown in FIG. 2, dome lids of this type typically include a drain hole 32 within bottom wall 22 positioned near the lowest level in primary recess 20. The inversely downwardly and inwardly sloping bottom wall 22 drains liquid to the lowest level within primary recess 20, and drain hole 32 drains liquid trapped by primary recess 20 back into the cup. Drain hole 32 is sized sufficiently small as to not form a source for spillage. Rather, the drain hole 32 is of a small size which substantially restricts spillage therethrough caused by a sloshing beverage such as coffee within a cup being jostled about.

As more clearly illustrated in subsequent Figures, in order to substantially restrict spillage through drink opening 12 caused by a sloshing beverage such as coffee within a cup being jostled about, the drink opening 12 is configured having a permeable membrane 34 formed of a fine mesh or screen formed or installed therein substantially flush with the annular top wall 14 of the lid 10 and having a very small pore size which substantially restricts spillage therethrough caused by a sloshing beverage such as coffee within a cup being jostled about. The vent 28 is optionally configured having a permeable membrane 35 formed of a fine mesh or screen formed or installed therein substantially flush with the inner top plate 26 of the lid 10 and also having a very small pore size which also substantially restricts spillage therethrough caused by a sloshing beverage such as coffee within a cup being jostled about. While it will be understood that permeable membranes 34 and 35 are optionally configured in a number of effective ways to accommodate a variety of drink-through dome lids, a description will now be given that presents one effective manner of taking full advantage of the various features of the invention.

Figure 3:
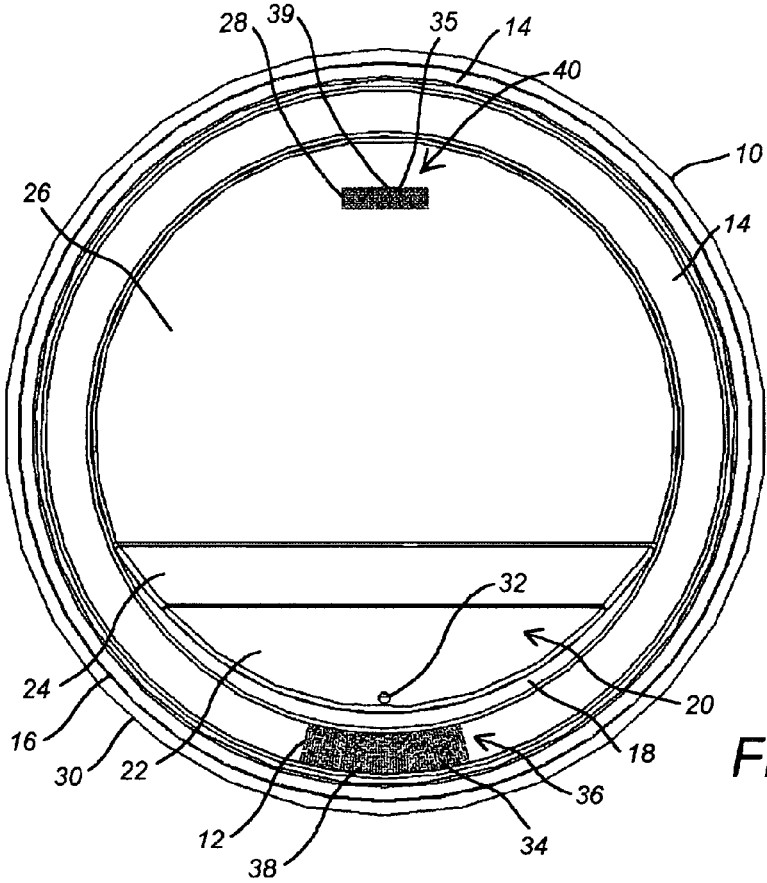
FIGS. 3 and 4 are close-up top elevation and pictorial views, respectively, illustrating by example and without limitation the drink-through opening being configured having a perforated permeable membrane formed therein, and the vent also being configured having a perforated permeable membrane formed therein.
Figure 4:
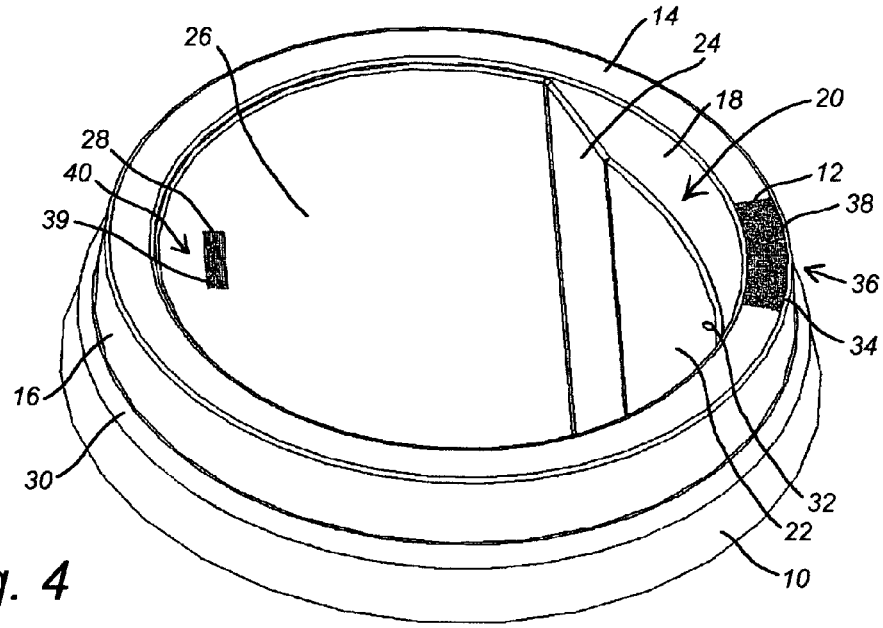

FIGS. 3 and 4 are close-up top elevation and pictorial views, respectively, more clearly showing the disposable lid 10 wherein the drink opening 12 is configured having the permeable membrane 34 formed therein, and similarly the vent 28 is also configured having the permeable membrane 35 formed therein. As illustrated here by example and without limitation, the very small pore size of the screen or fine mesh of permeable membrane 34 in the drink opening 12 is formed by a pattern 36 of very small individual pin prick outlet apertures or perforations 38.

The outlet perforations 38 for both the permeable membranes 34 and 35 are two-way perforations, whereby flow may occur in either direction. Accordingly, when utilized for the drink opening 12, the outlet perforations 38 of the permeable membrane 34 permit the liquid beverage to exit the cup. When utilized for the vent 28, the perforations 38 of the permeable membrane 35 permit air to enter the cup for replacing the discharged liquid beverage and equalizing pressure with the ambient atmosphere outside the cup.

The pattern 36 of outlet perforations 38 for the drink opening 12 is selected to be small enough to fit comfortably and completely within the drinker's mouth and with the drinker's lips sealing the annular top wall 14 of the lid 10 on each side of the drink-through opening 12.

The quantity of outlet perforations 38 for the pattern 36 of the permeable membrane 34 is selected to provide an aggregated throughput area similar to the throughput area of prior art cup lids such as those disclosed by any of Horner in U.S. Pat. No. 5,065,880; Crudgington, Jr. in published United States Patent Application 20050173443; Clements in U.S. Pat. No. 4,589,569; Clarke in U.S. Pat. No. 6,644,490; and Van Melle, et al. in U.S. Pat. No. 5,253,781, which are all incorporated in their entirety herein by reference. At least the quantity of outlet perforations 38 for the pattern 36 of the permeable membrane 34 is selected to provide an aggregated throughput area sufficient for the drinker to comfortably consume therethrough the beverage in the cup.

The permeable membrane 35 in the vent 28 is optionally formed of the same pattern 36 or another pattern 40 of very small individual outlet perforations 38. The respective patterns 36 and 40 of very fine outlet perforations 38 replace the conventional relatively enlarged single drink and vent hole openings known and practiced in the prior art. Therefore, the pattern 36 of very fine outlet perforations 38 that form the permeable membrane 34 in the drink opening 12 are positioned in the annular top wall 14 of the lid 10 convenient to the user. The pattern 40 of very fine outlet perforations 38 that form the permeable membrane 35 in the vent 28 are positioned within inner top plate 26 opposite from the drink opening 12 to reliably vent air into the cup during beverage consumption.

Figure 5:
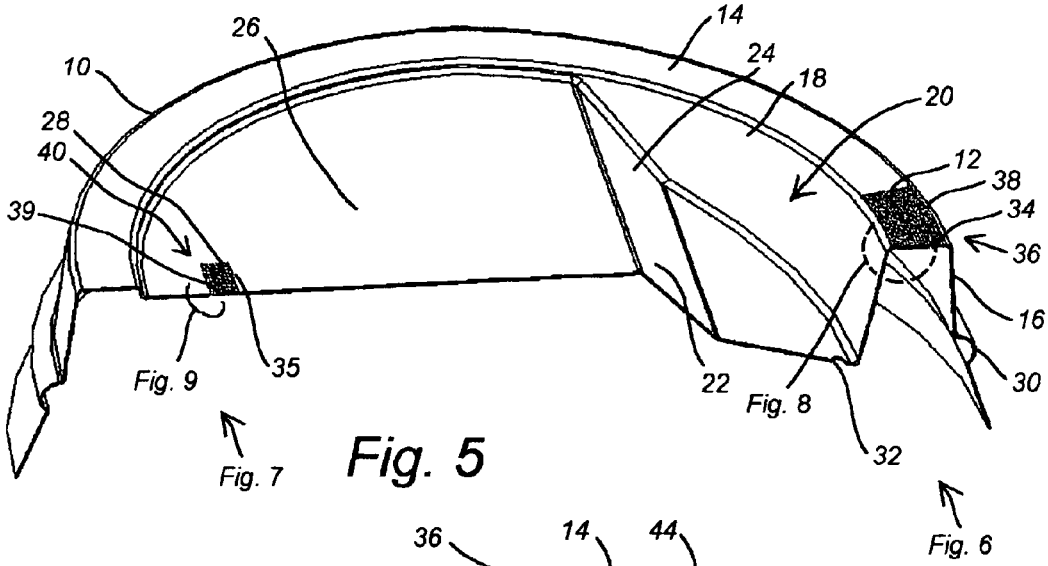
FIG. 5 is a section view of the novel disposable cup closure illustrating by example and without limitation the drink-through opening being configured having a perforated permeable membrane formed therein, and the vent also being configured having a perforated permeable membrane formed therein.

FIG. 5 is a section view of the disposable lid 10 showing the drink-through opening 12 being configured having the permeable membrane 34 formed therein, and the vent 28 also being configured having the permeable membrane 35 formed therein. As illustrated here, and more clearly in FIG. 6, the very fine outlet perforations 38 forming the two permeable membranes 34 and 35 are much smaller even than the drain hole 32, which is itself small enough to substantially restricts spillage therethrough caused by a sloshing beverage such as coffee within a cup being jostled about.

Figure 6:
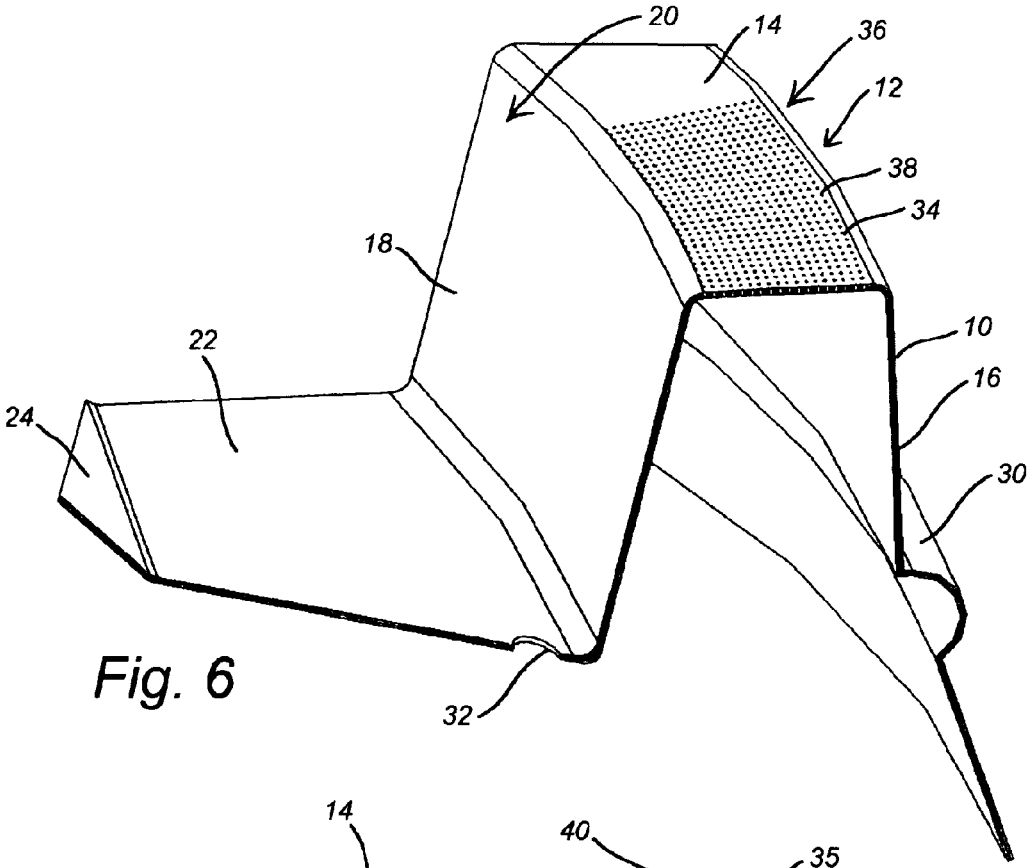
FIGS. 6 and 7 are close-up partial section views of the novel disposable cup closure respectively illustrating more clearly by example and without limitation the drink opening being configured having a perforated permeable membrane formed therein, and a vent also being configured having a perforated permeable membrane formed therein.
Figure 7:
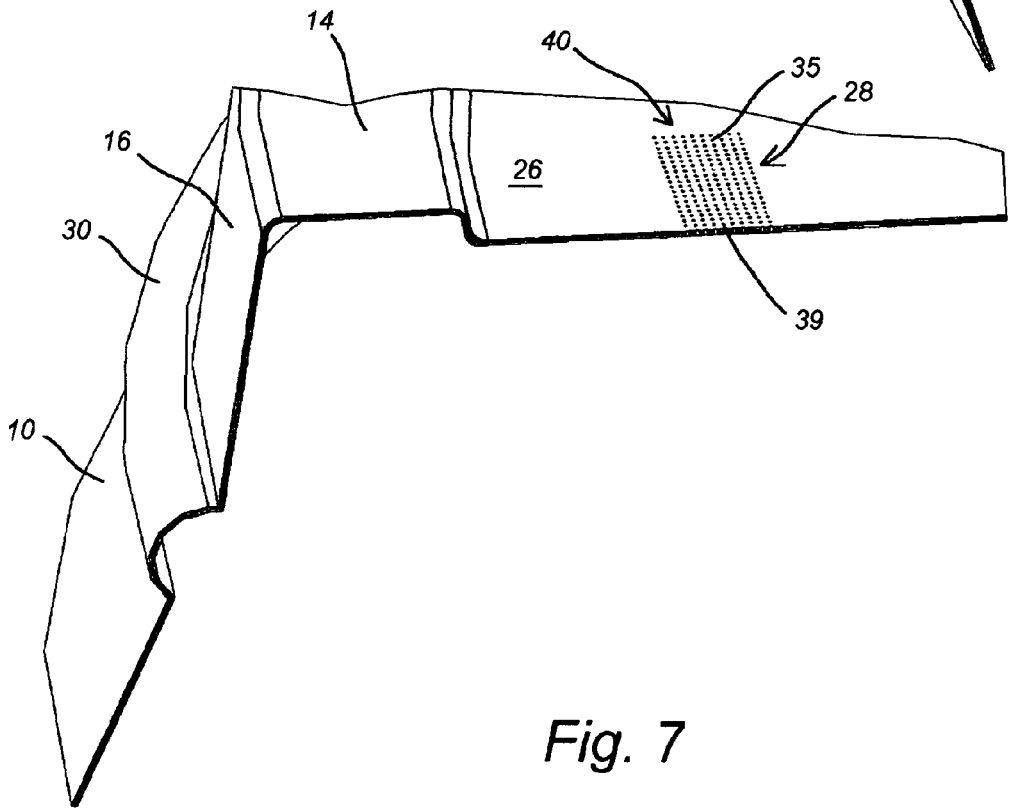

FIGS. 6 and 7 are close-up partial section views of the disposable lid 10 respectively more clearly showing the drink opening 12 being configured having the permeable membrane 34 formed therein, and the vent 28 also being configured having the permeable membrane 35 formed therein. As illustrated here, the very fine outlet perforations 38 forming the two permeable membranes 34 and 35 are much smaller even than the drain hole 32, which is itself small enough to substantially restricts spillage therethrough caused by a sloshing beverage such as coffee within a cup being jostled about.

Figure 8:
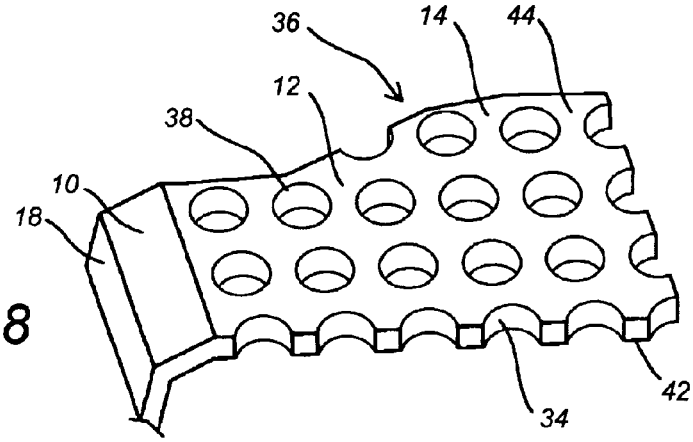
FIG. 8 illustrates by example and without limitation a permeable membrane drink-through opening of the novel disposable splash resistant dome type cup closure being formed with very fine outlet perforations.
Figure 9:
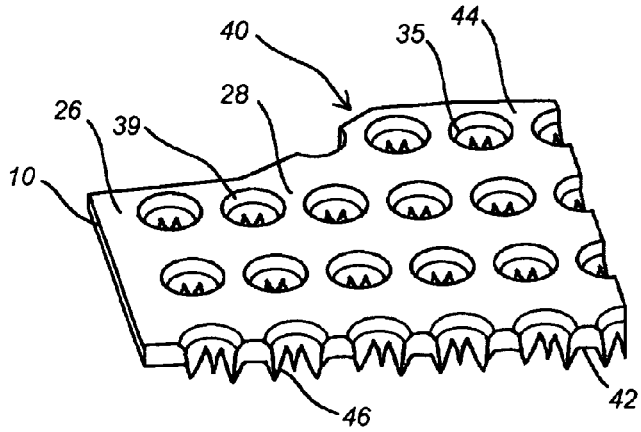
FIG. 9 illustrates by example and without limitation a permeable membrane vent of the novel disposable splash resistant dome type cup closure being formed with very fine outlet perforations.

FIGS. 8 and 9 are close-up partial section views of the disposable lid 10 more clearly showing different configurations of the permeable membrane 34 formed in the drink opening 12 and the permeable membrane 35 formed in the vent 28, respectively.

As illustrated by example and without limitation in FIG. 8, the permeable membrane 34 is formed of a pattern 36 of the very fine pin prick outlet apertures or perforations 38. Optionally, the pattern 36 of outlet perforations 38 is random. However, as further illustrated in FIG. 8, the patterns 36 and 40 of pin prick outlet perforations 38 forming the screen or mesh of permeable membranes 34 may be regular patterns substantially aligned along either Cartesian or polar coordinates. As illustrated herein by example and without limitation, when the pin prick outlet perforations 38 are aligned along polar coordinates, the pattern 36 of the permeable membrane 34 for drink opening 12 is optionally formed substantially concentric with the annular top wall 14 of the lid 10. The pin prick outlet perforations 38 forming the screen or mesh of permeable membrane 34 may be substantially round, as illustrated, or may be square or another non-round shape, including slits that are substantially longer in one dimension than a width in a cross dimension. The very fine outlet perforations 38 forming the permeable membrane 34 of the drink opening 12 are sized as a function of the expected viscosity and surface tension of the liquid intended to fill the cup in such manner as to produce a throttle effect on the of the liquid in the cup.

The viscosity of a liquid is known to be a measure of that fluid's resistance to flow when acted upon by an external force such as a pressure differential or gravity. Viscosity is a general property of all fluids that is affected by changes in temperature: an increase in temperature generally decreases liquid viscosity. Viscosity affects the size of liquid particles or droplets: decreasing the viscosity tends to decrease the size of the droplets. The smaller sized droplets of lower viscosity liquid pass more easily through smaller apertures, while larger droplets must be broken down to pass through the same apertures. In the present context of passing the liquid in the cup through the permeable membrane 34, more force or pressure must be applied to a high-viscosity liquid than to a low-viscosity liquid to attain the same liquid flow rate for a given pore size of the outlet perforations 38.

It is also known that the same intermolecular forces that determine viscosity create surface tension in the liquid. Surface tension is a measure of the internal forces generated by molecules due to their position in the surface of a the liquid. Surface tension forms what appears to be a membrane on the free surface of a liquid that allows insects to rest and pine needles to float on the surface of pond water. Surface tension also accounts for the formation of puddles on smooth surfaces and stops water overflowing a full glass. Surface tension also causes a tendency in liquid droplets to form a spherical shape since this shape produces the least amount of surface area for a given volume.

It is generally well-known that, since viscosity and surface tension are closely related, surface tension determines the size of liquid droplets in the same manner as viscosity. As surface tension increases, droplet size also increases. For example, mercury at room temperature tends to form larger droplets than water and oil do because mercury has a higher surface tension. Surface tension thus corresponds to the size of liquid particles or droplets formed by the liquid in the cup, and therefore directly affects the ease with which the liquid in the cup flows through the outlet perforations 38 forming the permeable membrane 34.

Therefore, as a function of both the viscosity and surface tension of the liquid in the cup, the throttle effect of the very fine outlet perforations 38 interrupts flow therethrough of beverage in the cup that inadvertently encounters the pattern 36 of permeable membrane 34 in the drink opening 12 due to sloshing. Furthermore, the resultant throttle effect prevents spills and splashes when the beverage liquid is in contact with the permeable membrane 34 in a steady state, as by tilting or tipping the cup. Even having the cup laying on its side, the very fine outlet perforations 38 of the permeable membrane 34 are sized as a function of the viscosity and surface tension of the liquid in such manner that the throttle effect slows flow therethrough to a trickle. Thus, the permeable membrane 34 virtually plugs the drink-through opening 12 during times that the beverage is not being consumed.

Here, the beverage intended to fill the cup used with the cup lid 10 is a common water-based beverage, including fruit juice, soda, milk, and either hot or iced coffee or tea, both with and without additives. Therefore, the outlet perforations 38 of the permeable membrane 34 are sized as a function of both the viscosity and surface tension of a water-based liquid beverage to produce the throttle effect described herein that effectively interrupts flow of beverage that inadvertently encounters the pattern 36 of permeable membrane 34 in the drink opening 12 due, for example, to sloshing.

By example and without limitation, for a common beverage such as coffee or another hot or iced water-based beverage, the outlet perforations 38 of the permeable membrane 34 are sized generally on the order of holes made in a conventional disposable splash resistant cup lid using a pin, such as an ordinary straight pin. For example, the outlet perforations 38 optionally each have an average throughput area or cross-section in the approximate range of about 0.05 or 0.06 square millimeters up to about 0.10 square millimeters. In one embodiment, the outlet perforations 38 optionally each have an average throughput or cross-section area in the approximate range of about 0.08 to about 0.10 square millimeters, or about 0.003 to 0.004 square inches. Such an approximate range of average cross-section or throughput areas for the outlet perforations 38 is selected for water-based liquids such as tea and coffee because such cross-section or throughput areas have been determined to be effective by experimentation using a straight pin to form the outlet perforations 38 of the permeable membrane 34. The straight pin is used to just break through the lid 10, without pushing the entire body of the pin through the resulting pin prick.

Experimentation indicates that the average throughput or cross-section area of the outlet perforations 38 should not be more than about 0.12 square millimeters to avoid substantially reducing the effective throttle effect of the liquid permeable membrane 34.

As a function of the average cross-section or throughput area selected for the outlet perforations 38 and either an average viscosity and surface tension or ranges thereof of the water-based liquid beverage intended to fill the cup, the throttle effect interrupts flow therethrough of beverage in the cup that inadvertently encounters the permeable membrane 34 due to sloshing, but allows liquid in steady state contact with the permeable membrane 34 to drain slowly therethrough.

Alternatively, the average cross-section or throughput area for the outlet perforations 38 is selected as a function of either the average viscosity and surface tension or ranges thereof of the liquid intended to fill the cup such that the throttle effect substantially interrupts flow through the permeable membrane 34 even when the liquid is in steady state contact with the outlet perforations 38. Accordingly, the permeable membrane 34 operates as a siphon, such that a small pressure differential or suction must be applied to overcome pressure ratios between the water-based liquid in the cup and ambient air pressure outside the cup, which allows the liquid beverage to flow through the small pore size of the outlet perforations 38. Thus, in either case, whether a pressure differential is required to excite flow in a steady state of contact with the outlet perforations 38, or not, the membrane 34 is effectively permeable to water-based liquid beverages while producing that throttle effect that substantially interrupts flow therethrough.

A single average cross-section or throughput area for the outlet perforations 38 is expected to be effective for use with a narrow range of liquid viscosity and surface tension, whereby a single cup lid 10 is expected to be useful with a single beverage even when additives are mixed thereinto. For example, a single average cross-section or throughput area for the outlet perforations 38 is selected for most water-based liquids, such as tea and coffee, and is expected to be effective even when generous amounts of natural or artificial cream, sugar or artificial sweeteners are added. Such additives are not expected to significantly change viscosity or surface tension, except in narrow ranges, so the liquid is expected to flow effectively through the permeable membrane 34, even if slightly more sluggishly. The slight variations in liquid temperatures acceptable in the human mouth are also unlikely to significantly change either viscosity or surface tension, again except in narrow ranges, so that the effect on flow rate of the liquid through the permeable membranes 34 is not expected to be significant whether the beverage is steaming hot or icy cold.

As further illustrated in FIG. 8, the pin prick outlet perforations 38 of the water-based liquid permeable membrane 34 are formed as "clean" holes. In other words, the individual pin prick outlet perforations 38 are either cleanly molded in the cup lid 10 without burrs or flashing, or are cleaned or deburred following formation. Accordingly, opposing surfaces 42 and 44 both inside and outside of the cup lid 10 are optionally formed with substantially smooth finishes.

The permeable membrane 35 is optionally formed of the pattern 40 of very fine pin prick outlet apertures or perforations 38. Thus, the permeable membrane 35 in the vent 28 is optionally formed of substantially the same pin prick outlet perforations 38 forming the permeable membrane 34 in the drink opening 12. Although the perforations in the permeable membrane 35 are optionally substantially the same as the outlet perforations 38 in the permeable membrane 34, the pattern 40 is expected to be smaller than the pattern 36 since the intended function of the vent 28 is as a vent to equalize pressure in the cup as beverage is consumed through the drink opening 12.

However, since the vent 28 is intended to function as a vent for equalizing air pressure, only air is intended to pass through the outlet perforations 39 in the permeable membrane 35. Accordingly, as illustrated by example and without limitation in FIG. 9, the permeable membrane 35 is optionally alternatively formed of very small individual pin prick outlet apertures or perforations 39 having pore size different and optionally far smaller even than the small pore size of the outlet perforations 38 in the permeable membrane 34 of the drinking hole 12. Therefore, although the pore size of the outlet perforations 39 may be formed similarly to the outlet perforations 38 having an average cross-section or throughput area in the approximate range of about 0.05 or 0.06 square millimeters to about 0.10 square millimeters or as large as about 0.12 square millimeters, as discussed herein, the pore size of the outlet perforations 39 in the permeable membrane 35 for the vent 28 may optionally have an average cross-section or throughput area even less than about 0.05 square millimeters, yet large enough to allow the cup to breath, thereby eliminating a source for spillage. Accordingly, the membrane 35 only need be permeable to air to be effective.

As further illustrated in FIG. 9, the pattern 40 of pin prick outlet perforations 39 forming the screen or mesh of permeable membrane 35 may be a random pattern. However, as illustrated, the pattern 40 of outlet perforations 39 is optionally a regular pattern substantially aligned along either Cartesian or polar coordinates. As illustrated herein by example and without limitation, the pattern 40 of the individual pin prick outlet perforations 39 in the permeable membrane 35 for vent 28 are optionally aligned substantially along Cartesian coordinates within the inner top plate 26 of the cup lid 10. The individual pin prick outlet perforations 39 forming the screen or mesh of permeable membrane 35 may be substantially round, as illustrated, or may be square or another non-round shape, including slits that are substantially longer in one dimension than a width in a cross dimension. The very fine outlet perforations 39 forming the permeable membrane 35 of the vent 28 are sized as a function of the expected viscosity and surface tension of the liquid intended to fill the cup in such manner as to produce a throttle effect on the of the liquid in the cup.

The skilled person would therefore have the teaching to hand, to provide a specific size and number of outlet perforations 38 in each permeable membrane 34 such that only a specific flow rate is produced for a given liquid beverage. Thus, no undue experimentation is believed necessary to determine the appropriate size or quantity of the outlet perforations 38 and 39 for the permeable membranes 34 and 35 in either of the respective drink-through opening 12 or vent 28.

FIG. 9 illustrates the very fine outlet perforations 39 forming the permeable membrane 35 of the vent 28 being formed in the recessed inner top plate 26 of the cup lid 10. As discussed by Crudgington, Jr. in published United States Patent Application 20050173443, which is incorporated in its entirety herein by reference, stamping of drink-through openings is a common secondary process subsequent to vacuum-formation of thermoplastic material. The stamping process includes a vertically moving hardened metallic die impacting upon a softer metallic receiving surface with the thermoplastic material being supported by the receiving surface during the cutting process. In prior art, the manufacturing of disposable dome lids taught or implied the stamping of the drink-through openings with a substantially planar or 2-dimensional cut. Thus, the receiving surface used in die cutting was flat and the shape of the drinking hole stamped into the thermoplastic material was substantially planar. The present stamped cup lid 10 optionally uses a substantially planar or 2-dimensional cut for both the drinking opening 12 and the vent 28. However, the drink-through opening 12 and vent 28 set forth herein are created by a die having two pluralities of pin-sized cutters in close formation patterns that matches the footprints of the respective drink opening pattern 36 and vent pattern 40 in their respective positions. Since the steps used in production and post-production remain unchanged, the manufacturing costs are similar to prior art cup lids in high volume production.

The razor sharp cutting dies typically leave little or no burr in the cuts, similarly to the outlet perforations 38 illustrated in FIG. 8. However, the die cut method or another perforating method for forming one or both of the outlet perforations 38 and 39 may leave burrs behind. Accordingly, the respective permeable membranes 34 and 35 are optionally de-burred, which results in clean perforations 38 and 39 with substantially smooth finishes on both the inside and outside cup lid surfaces 42 and 44.

However, when the cup lids 10 are molded, flashing may result in the perforations 38 and 39. Else, when the cup lids 10 are vacuum-formed, the post-forming perforating method may leave burrs clinging in the perforations 38 and 39. The flashing or burrs result in prickly outcroppings (both indicated at 46) projected above one or both the inside and outside cup lid surfaces 42 and 44. The prickly flashing or burr outcroppings 46 are either substantially removed in a subsequent de-burring process, else are optionally retained substantially undisturbed so that the subsequent de-burring process is eliminated. When retained on the inside lid surface 42, as shown, the prickly flashing or burr outcroppings 46 may further inhibit splash through the outlet perforations 38 and 39 by further limiting access thereto. However, the retained flashing or burr outcroppings 46 are not expected to affect normal flow through the outlet perforations 38 and 39 since the actual cross-section or throughput area is unchanged. Therefore, retention of the flashing or burr outcroppings 46 may provide an optional enhancement to the anti-spill function of the cup lid 10 without increasing the throttle effect.

Figure 10:
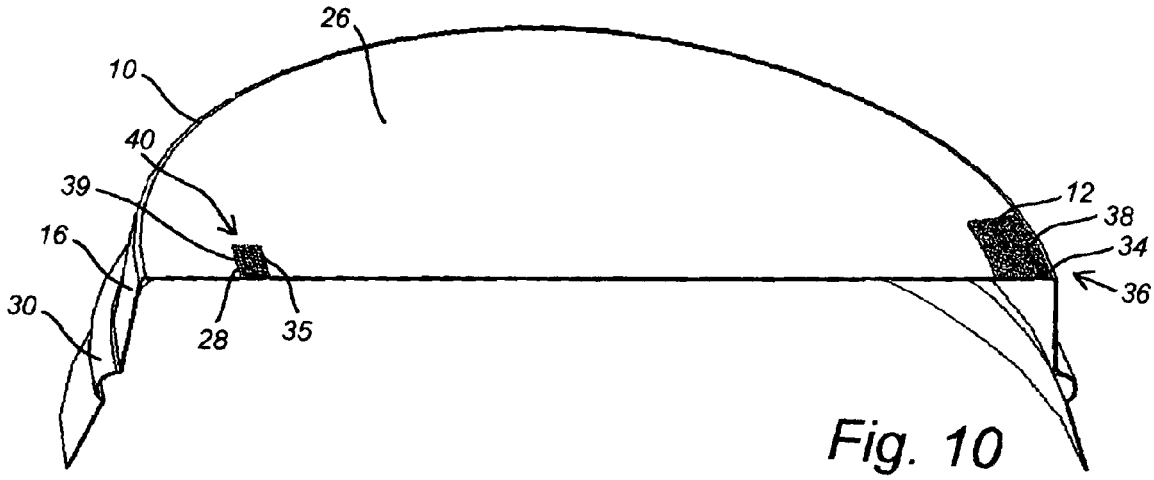
FIG. 10 illustrates by example and without limitation a minimalist configuration of the novel disposable splash resistant dome type cup closure with the drink-through opening.

FIG. 10 illustrates by example and without limitation a minimalist configuration of the disposable splash resistant dome type cup lid 10 with the drink-through opening 12. Here, the annular top wall 14 is folded into the inner top plate 26 to form a single substantially planar top plate 26 bounded on its outer perimeter by the downwardly and outwardly sloping annular outer sidewall 16. The top plate 26 and annular outer sidewall 16 provide the raised canopy forming the reservoir typical of the dome-type lid. The fine screens or meshes of permeable membranes 34 and 35 of the drink-through opening 12 and vent 28 are provided within opposite sides of the top plate 26 adjacent to the annular outer sidewall 16, which in turn extends above the mounting portion 30.

Figure 11:
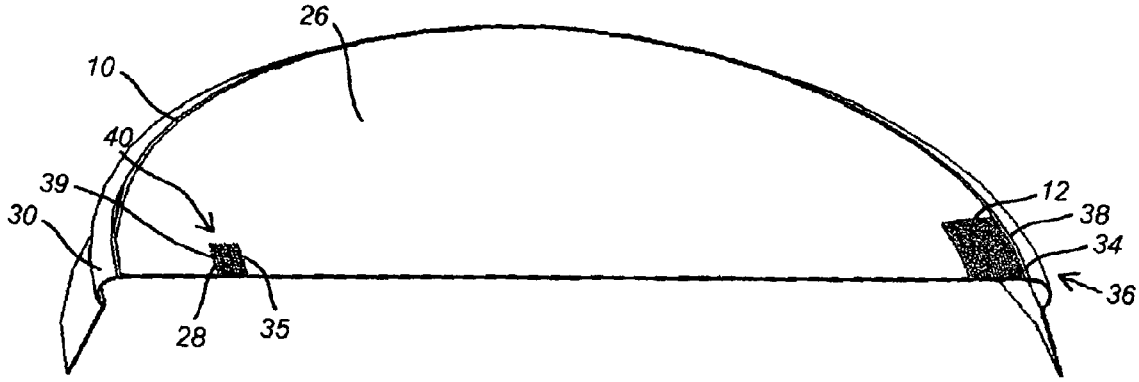
FIG. 11 illustrates by example and without limitation a minimalist configuration of the novel disposable splash resistant non-dome type cup closure with the drink-through opening and no reservoir formed above the cup rim.

FIG. 11 illustrates by example and without limitation a minimalist configuration of the disposable splash resistant non-dome type cup lid 10 with the drink-through opening 12. Here, the substantially planar top plate 26 bounded on its outer perimeter by the mounting portion 30 so that no reservoir is formed above the cup rim. Rather, the top plate 26 sits directly above the cup rim.

Figure 12:
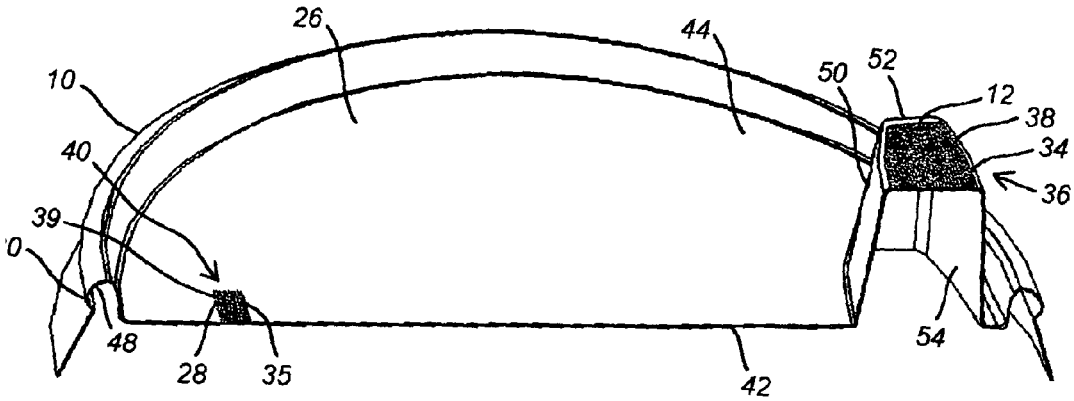
FIG. 12 illustrates by example and without limitation another configuration of the novel disposable splash resistant non-dome type cup closure with the drink-through opening in a contoured spout and having a mounting portion structured in a "plug fit" configuration.

FIG. 12 illustrates by example and without limitation another configuration of the disposable splash resistant non-dome type cup lid 10 with the drink-through opening 12. Here, the mounting portion 30 is structured having a "plug fit" configuration, as discussed for example in published United States Patent Application 20050173443, which is incorporated in its entirety herein by reference. Accordingly, an inverted annular groove 48 surrounds the lid's substantially planar top plate 26 into which the lip of the cup extends so that pressure is applied not only to the cup lip's outer edge but to the inner edge as well and eliminates the cup's lip caving inward causing the seal to break so that the plug fit cup lid 10 can be applied to less expensive cups having a weaker sidewall. See, e.g., U.S. Pat. No. 4,057,167, Valved Receptacle Closure, to Jin Ku Lee, which is incorporated in its entirety herein by reference; see, also, U.S. Pat. No. 4,090,660, Disposable Drinking Cup Lid, to Robert A. Schram; U.S. Pat. No. 4,473,167, Container Lid Construction, to John A. Bailey; U.S. Pat. No. 5,065,880, Splash Resistant Cup Lid, to Horner; U.S. Pat. No. 5,253,781, Disposable Dome Lid For Drinking Cups, to Van Melle, et al.; U.S. Pat. No. 5,911,331, Dome Lid For Drinking Cup, to Peter K. Boller; U.S. Pat. No. 6,089,397, Cup Lid Having Improved Drink-Through Opening, to Van Melle, et al., which are all incorporated in its entirety herein by reference. The "plug fit" configuration of the mounting portion 30 is also useful with the dome-type cup lid 10. See, e.g., U.S. Pat. No. 4,441,624, Drinking Cover, to Bronislaw Sokolowski, which is incorporated in its entirety herein by reference.

Additionally, the cup lid 10 is illustrated here by example and without limitation as having a contoured spout 50 terminated in the drink-through opening 12. This type of cup lid is often used with flow control apparatus for the drinking cups of small children, also commonly referred to as a "sippy cup." However, such funnel-type contoured spouts are also used on both hot and cold take-out beverage cups for adults. See, e.g., U.S. Pat. No. 5,894,952, Spill-Resistant Cup Lid With Condiment Funnel And Stirring Rod, to Robert Scott Mendenhall, et al., which is incorporated in its entirety herein by reference.

Accordingly, the cup lid 10 is illustrated here by example and without limitation as having the contoured spout 50 projected from the top plate 26 and forming a funnel that is terminated at its distal end 52 from the top plate 26 in the drink-through opening 12. The distal end 52 of the spout 50 may be slightly angled, or tapered, toward the periphery of the lid 10 in order to more comfortably accommodate the consumer's mouth and to aid in directing the flow of the beverage. Height, width and depth of the spout 50 are selected and adjusted to accommodate the proportions of a particular size of lid. The spout 50 is formed with an internal, substantially continuous, downwardly depending surface 54 that forms a funnel for directing the beverage from the cup to the drink-through opening 12. The fine screen or mesh permeable membrane 34 of outlet perforations 38 is formed in the distal end 52 of the spout 50 and, optionally, substantially flush therewith.

FIGS. 13 and 14 are close-up partial section views of the disposable lid 10 respectively more clearly showing the drink opening 12 being configured having the water-based liquid permeable membrane 34 installed therein, and the vent 28 also being configured having the air or water-based liquid permeable membrane 35 installed therein. As illustrated here, the two permeable membranes 34 and 35 are formed separately from a main body 56 containing the remaining features of the cup lid 10. Here, the two permeable membranes 34 and 35 are formed of the same or a similar plastic material as the lid main body 56. For example, the two permeable membranes 34 and 35 are die cut to form the respective patterns 36 and 40 of perforations 38 and 39 in respective discrete membranes 58 and 60, for example thin plastic webs or screens. Rather than being formed with the permeable membranes 34 and 35 in place, the lid main body 56 is formed with respective enlarged solitary drink-through apertures 62 and 64 through the annular top wall 14 and inner top plate 26, respectively, at the positions of the drink-through and vent openings 12 and 28. Thus, the main body 56 of the cup lid 10 is initially formed similarly to the finished cup lids of prior art processes. Thereafter, in a secondary operation to forming the lid main body 56 with the solitary apertures 62 and 64, the preformed permeable membranes 34 and 35 are laminated, heat-sealed or otherwise bonded into the respective apertures 62 and 64 to form the meshed drink-through and vent openings 12 and 28. Accordingly, a laminate, heat-seal or other bond joint 65 is formed between each of the respective preformed permeable membranes 34 and 35 and the lid body 56 around the respective drink-through and vent apertures 62 and 64.

Alternatively, one or both of the preformed permeable membranes 34 and 35 are formed of a matt of very porous filter material laminated, heat sealed or otherwise joined or attached to the lid main body 56 in or over the respective solitary apertures 62 and 64. By example and without limitation, the preformed permeable membranes 34 and 35 are formed as a microfibrous filtration material formed of a highly permeable layer of a mesh web or mat of self-supporting plastic or nonwoven fabric which optionally supports a layer of a randomly intertangled nonwoven mat of microfibers of synthetic polymers or natural substances such as cellulose. Winters discloses one such microfibrous filtration material in U.S. Pat. No. 4,917,942, Nonwoven Filter Material, which is incorporated in its entirety herein by reference, useful as disposable filter bags or as a lining material for disposable paper filter bags for vacuum cleaners, which is characterized by thickness and handling characteristics approaching that of paper filter material typically use in disposable vacuum clean bags but having improved performance in the areas of an immediate, high particle capture efficiency, minimal flow restriction and long service life, wherein the microfibrous filtration laminate is disclosed as a highly permeable layer of a self-supporting nonwoven fabric which provides support for a layer of a randomly intertangled nonwoven mat of electret-containing microfibers of synthetic polymers are disclosed.

FIG. 15 illustrates by example and without limitation one example of a microporous mesh material 67 that may be useful as the preformed liquid-permeable and air-permeable membranes 34 and 35. Accordingly, by example and without limitation, the microporous mesh material 67 is characterized, for example, by a laminated structure of a porous mesh layer of self-supporting plastic or nonwoven fabric web or mat 69. Here, the term "self-supporting" is intended to mean that the porous mesh layer 69 is strong enough to resist collapse while the water-based liquid beverage is poured or sucked therethrough. The self-supporting porous mesh layer 69 is selected such that it has sufficient porosity that it contributes minimally to the flow restriction of air passing through the structure, yet it possess sufficient strength and dimensional stability that it provides for the structural integrity of a fabricated filter apparatus. In addition to the above mentioned properties, it is desirable that the self-supporting porous mesh layer 69 have a thickness and handling characteristics similar to that of the main body 56 of the cup lid 10.

Optionally, the self-supporting porous mesh layer 69 comprises a consolidated web or mat of substantially continuous and randomly deposited molecularly oriented filaments of a thermoplastic polymer such as those produced in a spunbond process that produces a porosity in the self-supporting porous mesh layer 69 that further permits the passage of the beverage in the cup. The self-supporting porous mesh layer 69 must be highly porous such that it contributes minimally to the liquid flow restriction of the microporous mesh material 67. According to one embodiment, the self-supporting porous mesh layer 69 has a porosity that contributes less than about 10 percent to the fluid flow restriction and more preferably it contributes less than about 5 percent, such that the beverage in the cup can flow through the microporous material 67 upon demand by the drinker. One option for the self-supporting porous mesh layer 69 for use in the preparation of the microporous mesh material 67 is a polypropylene spunbond material of a known and commercially available type.

Optionally, the microporous mesh material 67 is a filter material that optionally also includes a layer of a randomly intertangled nonwoven web or mat 71 of electret-containing microfibers of synthetic polymer coextensively deposited on and adhering to the self-supporting mesh layer 69. If present, the fibers in the optional electret-containing web or mat 71 are selected to produce a porosity in the microporous filter material 67 that further permits the passage of the beverage in the cup. The microfibers of the randomly intertangled electret-containing web 71 are preferably based on melt blown microfibers (BMF) prepared from polyolefins and more preferably from polypropylene. They should have an effective fiber diameter that does not significantly contribute to the fluid flow restriction and permits the beverage in the cup to flow through the filter material 67 upon demand by the drinker. For a discussion of effective fiber diameter and how it is determined, see, e.g., "*The Separation of Airborne Dust and Particles*," Institution of Mechanical Engineers, London, Proceedings 1B, 1952. This and similar though more porous microfibrous filtration materials are also contemplated for use as the preformed permeable membranes 34 and 35 and may be substituted without deviating from the scope and intent of the present invention. Accordingly, the preformed liquid-permeable membranes 34 and 35 may be another plastic or nonwoven fabric filter medium, such as disclosed by example and without limitation by Kondo, et al. in U.S. Pat. No. 6,136,409, Nonwoven Fabric, Filter Medium And Process For Producing The Same, which is incorporated in its entirety herein by reference, which discloses a nonwoven fabric formed of thermoplastic resin fiber bundles. U.S. Pat. No. 6,136,409 discloses that a nonwoven fabric of uniform structure composed of unoriented fine fibers can be obtained by melt-blowing. In another example, in U.S. Pat. No. 6,169,045, Nonwoven Filter Media, which is incorporated in its entirety herein by reference, Pike, et al. discloses a lofty filter medium for filtering fluid-borne particles, which is formed of a nonwoven fiber web of crimped fibers selected from the group consisting of spunbond fibers and staple fibers, wherein the filter medium has a density between about 0.005 g/cm$^3$ and about 0.1 g/cm$^3$. The lofty filter medium is highly suitable for fluid-borne particle filtration applications, including water and the like, and may be incorporated as one or both of the permeable membranes 34 and 35. However, here the microporous filter material 67 of the preformed permeable membranes 34 and 35 is optionally formed of the same thermoplastic material as the lid main body 56. In another embodiment, the permeable membranes 34 and 35 are formed as the microporous filter material 67 during formation of the lid main body 56 and integral therewith.

Figure 16:
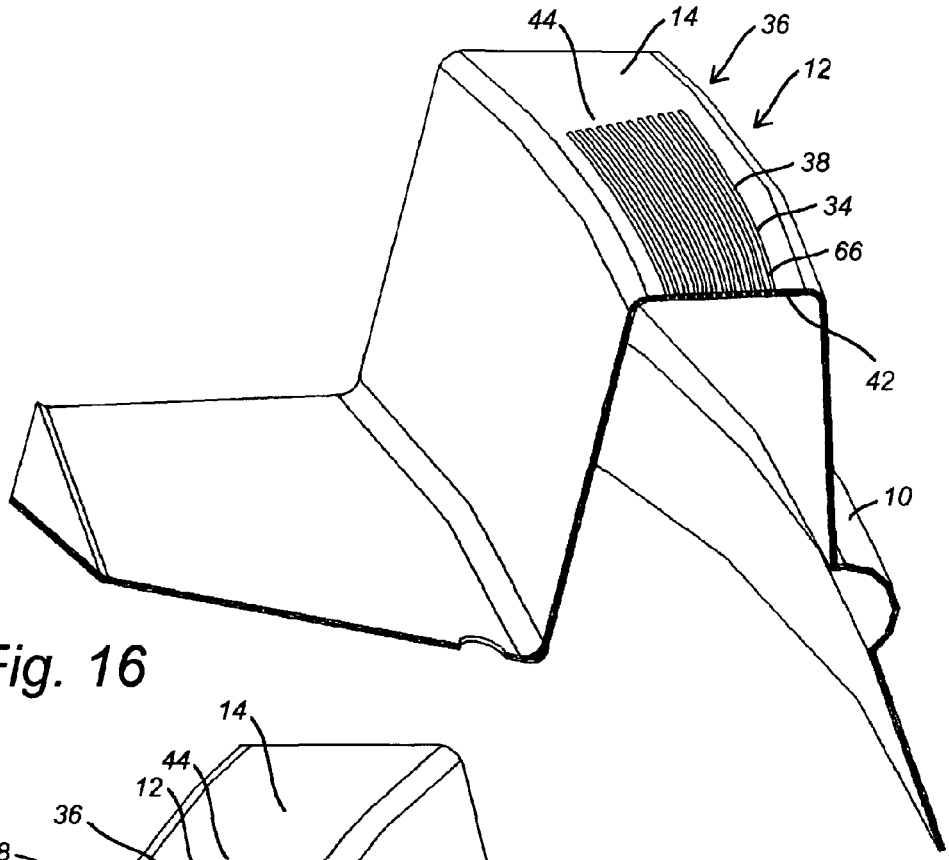
FIGS. 16 and 17 are respective close-up partial section views of the novel disposable cup closure more clearly showing the drink opening being configured having the permeable membrane installed or formed therein.
Figure 17:
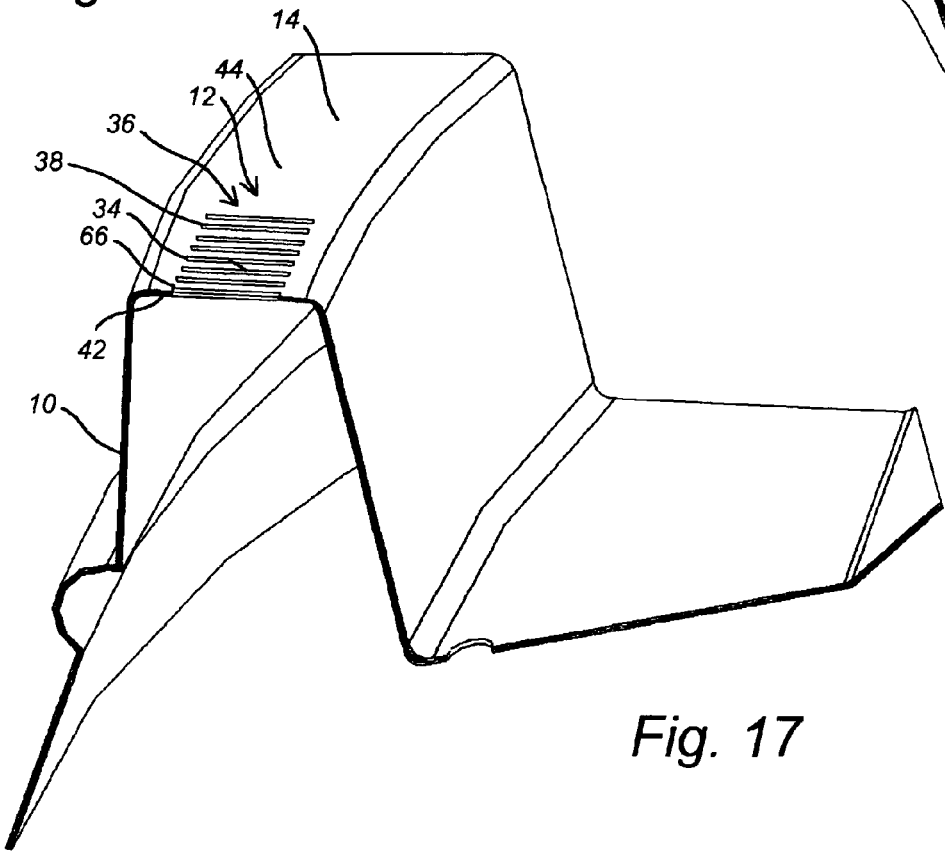

FIGS. 16 and 17 are close-up partial section views of the disposable lid 10 respectively more clearly showing the drink opening 12 being configured having the permeable membrane 34 installed or formed therein. As illustrated here, the very fine outlet perforations 38 forming the permeable membrane 34 are formed as very narrow slits 66. The slits 66 that form the outlet perforations 38 are sufficiently narrow as to produce the throttle effect on the of the liquid in the cup as a function of the expected viscosity and surface tension of the liquid intended to fill the cup. For example, the slits 66 that form the fine outlet perforations 38 optionally each have an average throughput area or cross-section in the approximate range of about 0.05 or 0.06 square millimeters to about 0.10 square millimeters, but may be as large as about 0.12 square millimeters, as discussed herein regarding the pin prick apertures illustrated in previous Figures. In one embodiment, the slits 66 forming the outlet perforations 38 optionally each have an average throughput area or cross-section in the approximate range of about 0.08 to 0.10 square millimeters, or about 0.003 to 0.004 square inches. As discussed herein, such an approximate range of average cross-section or throughput areas for the outlet perforation slits 66 is selected for water-based liquids such as tea and coffee because such cross-section or throughput areas have been determined by experimentation to be effective.

According to one embodiment, the outlet perforation slits 66 optionally have a width in the approximate range of about 0.05 or 0.06 millimeters to about 0.10 millimeters, but may be as wide as about 0.12 millimeters, as discussed herein regarding the pin prick apertures illustrated in previous Figures.

According to another embodiment, the outlet perforation slits 66 are optionally formed without removing any substantially amount of material from the lid 10. Rather, the outlet perforation slits 66 are substantially mere slices through the lid material that do not even significantly displace material, but rather form a discontinuity in the structure of the lid material, as if cut with a razor blade. Alternatively, as a function of the length and number of the outlet perforation slits 66 in combination with the expected viscosity and surface tension of the liquid intended to fill the cup, the outlet perforation slits 66 may be depressed slightly along their lengthwise edges to form a long, narrow opening between the inner and outer lid surfaces 42, 44. The outlet perforation slits 66 thus optionally form louvers or baffles having long, narrow opening between the inner and outer lid surfaces 42, 44 of the cup lid 10. The outlet perforation slits 66 optionally have a width in the approximate range of about 0.05 or 0.06 millimeters to about 0.10 millimeters, but may be as wide as about 0.12 millimeters, as discussed herein regarding the pin prick apertures illustrated in previous Figures.

The slits 66 are formed either substantially across the cup lid diameter (FIG. 16) or along the cup lid diameter (FIG. 17). When formed substantially across the cup lid diameter, the slits 66 are optionally either substantially straight slits or arcuate slits (shown) substantially concentric with the lid 10 and its annular top wall 14. When formed substantially along the cup lid diameter, the slits 66 are optionally either substantially radial slits or parallel slits (shown) substantially parallel with a diameter of the lid 10. However, slits oriented at different angles to the cup lid diameter are also contemplated and may be included or substituted without deviating from the scope and intent of the present invention.

The air permeable membrane 35 in the vent 28 is also optionally formed of the outlet perforation slits 66.

Either or both of permeable membranes 34 and 35 are optionally formed as the respective discrete membranes 58 and 60 separately from the main body portion 56 containing the remaining features of the cup lid 10, while the lid main body 56 is formed with the respective enlarged solitary apertures 62 and 64 through the annular top wall 14 and inner top plate 26, respectively, at the positions of the drink-through and vent openings 12 and 28 similarly to the finished cup lids of prior art processes. In a secondary operation, the preformed permeable membranes 34 and 35 having the outlet perforation slits 66 are laminated, heat-sealed or otherwise coupled into the respective apertures 62 and 64 to form the meshed drink-through and vent openings 12 and 28.

Figure 18:
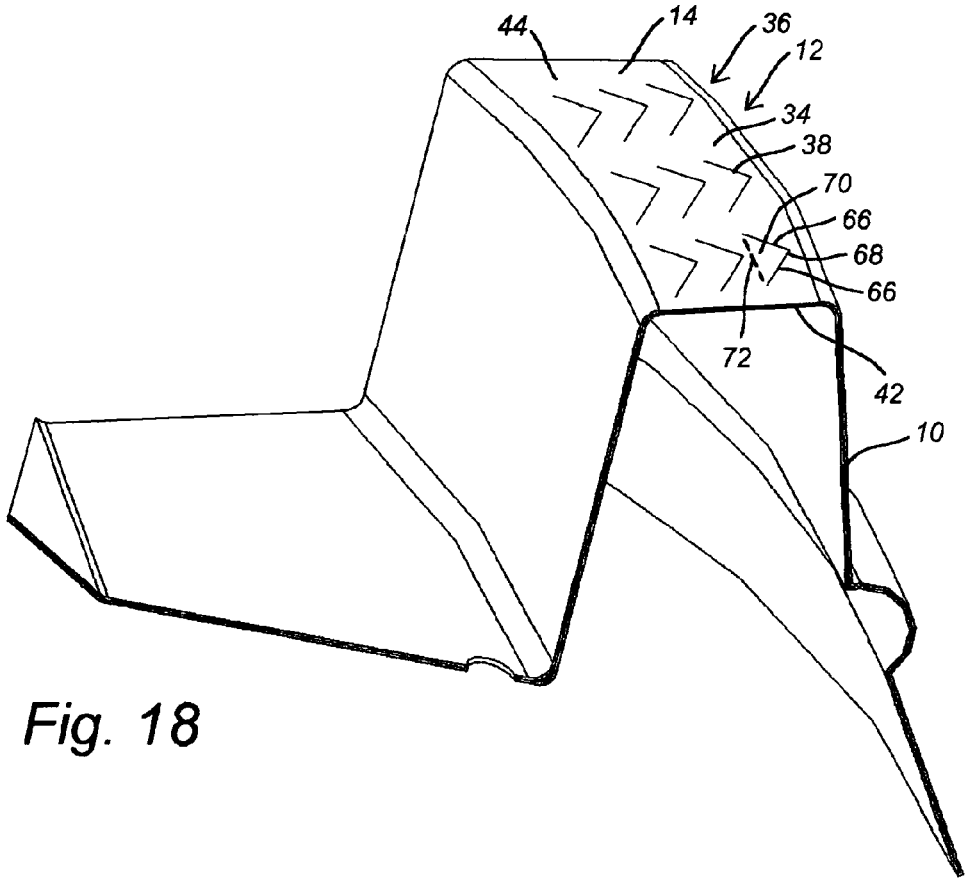
FIG. 18 is another close-up partial section view of the novel disposable cup closure that illustrates by example and without limitation the drink opening being configured having the permeable membrane installed or formed therein.

FIG. 18 is another close-up partial section view of the disposable lid 10 that illustrates by example and without limitation the drink opening 12 being configured having the permeable membrane 34 installed or formed therein. As illustrated here, the very fine outlet perforations 38 forming the permeable membrane 34 are formed as pluralities of the very narrow slits 66. The slits 66 that form the outlet perforations 38 here are sufficiently narrow as to produce the throttle effect on the of the water-based liquid in the cup as a function of the expected viscosity and surface tension of the liquid beverage intended to fill the cup. Here for example, a pair of the outlet perforation slits 66 are angled at opposite orientations relative to the lid diameter and intersect at a corner 68 in a "V" shape to form a plurality of chevrons as the permeable membrane 34. However, the outlet perforation slits 66 are optionally formed in a "C" or part-circle shape without deviating from the scope and intent of the present invention.

Here, by example and without limitation, the chevron outlet perforation slits 66 form triangular flaps 70 of the lid material that effectively result in valves that are normally closed because the triangular flaps 70 are held down against the annular top wall 14 of the lid 10 by their respective uncut third side (indicated by dashed line 72) or their straight side when presented as the "C" or part-circle shape described herein. The small normally closed valves formed by the flaps 70 produce a throttle effect on the of liquid in the cup. A small pressure differential or suction must be applied to overcome resistance of the flaps 70 to open by bending along their uncut third or straight sides 72, which allows the liquid to flow through the small valves formed by the chevron outlet perforation slits 66. The valve flaps 70 return to the normally closed configuration when the pressure differential of the suction is released, i.e., when the user stops drinking.

Optionally, the uncut third or straight sides 72 are creased to permit the flaps 70 to bend more easily, which reduces the pressure differential or suction required to open the valves.

It will thus be seen the present cup lid 10 is a new and improved drink-through disposable dome lid having a number of advantages and characteristics, including those pointed out herein and others which are inherent in the invention.

Figure 19:
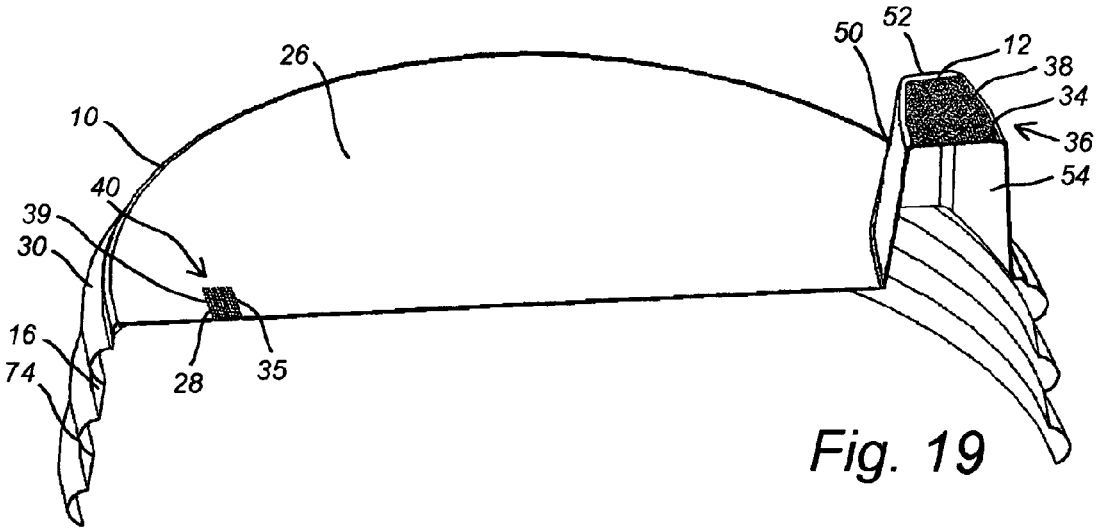
FIG. 19 illustrates by example and without limitation the novel reusable cup closure being configured as a useful alternative to more complex "sippy cup" lids of the prior art for flow control in the drinking cups of small children, wherein the novel "sippy cup" closure is illustrated by example and without limitation as being a screw-on type closure for threadedly affixing the lid to a screw-on type drinking cup.

Furthermore, it will be seen that the present cup lid 10 is easily modified to accommodate other personal beverage containers, including but not limited to nondisposable drinking cups, bottle-type beverage containers, and can-type beverage containers. Additionally, the cup lid 10 is optionally formed of a heavier plastic material so as to be reusable. For example, in FIG. 19 the reusable cup lid 10 is illustrated by example and without limitation as being a useful alternative to more complex "sippy cup" lids of the prior art for flow control in the drinking cups of small children. Here, the "sippy cup" lid 10 is illustrated by example and without limitation as being a screw-on type lid. Accordingly, the "sippy cup" lid 10 is illustrated as having mounting portion 30 formed as threads 74 on the outer sidewall 16 in order to threadedly affix the lid 10 to a screw-on type drinking cup.

Alternatively, the heavier reusable cup lid 10 is configured with as a screw-on lid for bottled beverages, such as water and soda. Also, the cup lid 10 is alternatively easily configured having either the "plug fit" or non-plug type mounting portion 30 sized to fit snuggly on a pop-top personal beverage can, such as soda or beer.

Figure 20:
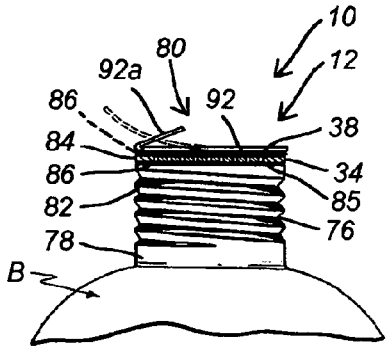
FIG. 20 illustrates the novel drink-through closure for a personal beverage container embodied by example and without limitation as a splash resistant closure affixed to a bottle-type personal beverage container.

FIG. 20 illustrates the drink-through closure 10 for a personal beverage container embodied by example and without limitation as a splash resistant closure affixed to a bottle-type personal beverage container B. Here, the bottle-type personal beverage container B is, by example and without limitation, a personal beverage cup of a type described in the prior art. The bottle-type personal beverage container B may be formed of any glass, soft plastic or another desired material, and is either disposable or recyclable. When formed of soft plastic, the bottle-type personal beverage container B is often a flexible resilient plastic container, the walls of which may be compressed inwardly or squeezed to decrease its interior volume for assisting in the dispensing of the liquid beverage therein. Such bottle-type personal beverage containers are generally well-known as disclosed, for example, by Wallace L. Speiche in U.S. Pat. No. 3,174,661, Dispenser Cap Having A Sliding Closure, which is incorporated in its entirety herein by reference. The bottle-type personal beverage container B is typically provided with a narrow drinking or discharge spout 76 formed of a thick annular neck 78 forming a discharge or dispensing orifice 80 communicating with the container's interior. The neck 78 is either formed with external threads 82 or an other means for retaining in place thereupon a either resealable or optionally disposable mating closed-end bottle cap A, as shown by example and without limitation in one or more subsequent Figures.

Figure 21:
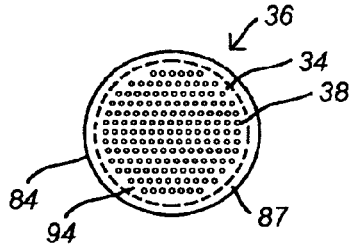
FIG. 21 illustrates by example and without limitation the novel the permeable membrane of the drink-through opening portion of the closure of FIG. 20 configured for use with a bottle-type personal beverage container.

As shown here in cross-section, and more clearly shown in flat pattern in the plan view of FIG. 21, the permeable membrane 34 of the drink-through opening portion 12 of the closure 10 is provided by an otherwise substantially fluid impervious film or membrane 84 formed with the pattern 36 of very small individual pin prick outlet apertures or perforations 38 described herein. The thin film 84 is secured peripherally to the topmost wall of the discharge spout 76 to create a control against inadvertent flow or spillage through the dispensing orifice 80. The film 84 is fixedly secured in place against the container's discharge spout 76 by a fusion joint 85 formed therebetween. Furthermore, the film 84 is of such strength that, when the container B is inverted, the seal will remain intact even under the weight of the container's contents. Such film-type protective seals are generally well-known as disclosed, for example, by Patterson in U.S. Pat. No. 6,457,613, Container Equipped With Protective Seal, which is incorporated in its entirety herein by reference.

U.S. Pat. No. 5,044,531, Bottle Having Spillage Prevention, to Rhodes, Jr., which is incorporated in its entirety herein by reference, discloses another example of such film-type protective seals for use as the substantially fluid impervious film 84. U.S. Pat. No. 5,044,531 discloses a thin plastic material covering that is optionally substituted for the film 84. Accordingly, the film 84 of which the permeable membrane 34 is formed is optionally a thin plastic material that is permanently secured to a perimeter of the discharge spout 76 of the container B and closes the dispensing orifice 80 to prevent the liquid therein from being poured from the container B when the container B is tilted.

U.S. Pat. No. 4,228,633, Method For Manufacturing, Filling And Closing A Receptacle Made Of Thermoplastic Material, to Corbic, which is incorporated in its entirety herein by reference, discloses another example of such film-type protective seals for use as the substantially fluid impervious film 84 for forming the permeable membrane 34. U.S. Pat. No. 4,228,633 discloses a foil covering that is optionally substituted for the film or membrane 84, referencing French Pat. No. 1 273 581. Accordingly, the film or membrane 84 is optionally a metal sheet or disc, e.g. aluminum foil, provided with a layer of glue, preferably thermo-adhesive, and to weld or crimp said foil on the perimeter of the discharge spout 76 around the dispensing orifice 80. For example, the foil covering is hermetically glued or welded in known manner. As disclosed by U.S. Pat. No. 4,228,633, a layer of heat-sealing adhesive establishes a sufficiently solid and sealed bond between the foil covering and the container's discharge spout. As also disclosed by U.S. Pat. No. 4,228,633, the foil covering optionally includes a tongue which is not covered with any layer of glue or adhesive. The tongue is used to pull the foil covering away from an dispensing orifice in the container's discharge spout.

U.S. Pat. No. 3,460,310, Container Closures, to Edmund Philip Adcock and Joan Ann Stanley, which is incorporated in its entirety herein by reference, discloses a metal foil membrane for sealing the mouth of a container that is optionally substituted for the film or membrane 84 for forming the permeable membrane 34. U.S. Pat. No. 3,460,310 also discloses a method of sealing a container mouth with a metal foil membrane bonded to the container finish, whereby the membrane is readily stripped away by the user to leave the finish un-impaired and ready for re-sealing. The method of U.S. Pat. No. 3,460,310 uses a metal foil membrane which is coated with a thermoplastic, and the membrane is pressed over the container mouth, while simultaneously being subjected to high frequency induction heating. The temperature and pressure conditions are designed such as to ensure that the membrane is readily strippable and that the finish is not impaired. Additionally, U.S. Pat. No. 3,460,310 discloses the method of bonding the metal foil membrane to the mouth of containers of different materials, including thermoplastic, glass, and metal. Accordingly, the film or membrane 84 for forming the permeable membrane 34 is optionally a metal foil membrane which is coated with a thermoplastic, and the membrane is pressed against perimeter of the discharge spout 76 around the container dispensing orifice 80, while simultaneously being subjected to high frequency induction heating, as disclosed in U.S. Pat. No. 3,460,310. Additionally, the film or membrane 84 is optionally bonded to the dispensing orifice

80 of containers B of different materials, including thermoplastic, glass, and metal containers.

U.S. Pat. No. 3,460,310 also discloses that it is known to make sealing membranes of a thermoplastic material and completely fusing the thermoplastic membrane to a container of thermoplastic material, which fusing is effected by an inductive heating method. Accordingly, the film or membrane 84 for forming the permeable membrane 34 is optionally such a thermoplastic membrane which is completely fused to the container B of thermoplastic material at the perimeter of the discharge spout 76 around the container's dispensing orifice 80, which fusing is effected by an inductive heating method.

U.S. Pat. No. 4,537,318, Dispensing Closure Lock And Seal, to Montgomery, which is incorporated in its entirety herein by reference, discloses a combined lock and seal element of a metallic, heat conductive material, such as aluminum. The metallic element can be very thin and is preferably between 0.0003 inches and 0.003 inches. A lower surface of the lock and seal element is coated with a layer of material which, when subjected to heat, will soften and will fuse with the material from which the container is made. By way of example, when the container itself is made of a polyvinylchloride or polypropylene material, an aluminum element or disk has a lamination or layer of material fusible with polyvinylchloride or polypropylene, respectively. U.S. Pat. No. 4,537,318 discloses that such facing material is available in any combination to suit almost any common container materials, including glass and most thermoplastics.

U.S. Pat. No. 4,537,318 discloses that the laminated or layered lock and seal element can be positioned inside of the bottle cap A and held in that position by wedging action or by the provision of separate protrusions on the inner wall surface, which are not shown. The complete closure assembly including the lock and seal element and the bottle cap A is then be threaded into closed position on the container to press the container and closure into tight engagement with opposite sides of the lock and seal element. This positioning of the closure assembly is done manually or by automatic capping equipment. Thereafter, the package with the container filled with the intended contents can be moved through an induction field such as provided by known apparatus. While the packages move continuously on a conveyor, an induction heater connected to a source of electrical energy not shown acts to heat the aluminum making up the aluminum foil disk to cause the softening of layer of fusible material and the adjacent surface of the container mouth, so that the surfaces weld together. The foil disk serves as the heat generating member to uniformly and rapidly distribute the heat and cause softening of the fusible layer. Both the power of the induction heater and the duration of exposure of the package to the field control the temperature attained by the foil as well as the time that it remains heated. After the package passes through the induction field, cooling occurs rapidly and a permanent connection is made between the container and the combination lock and seal element. Not only is the connection permanent but it also forms an unbreakable seal.

Accordingly, the film or membrane 84 for forming the permeable membrane 34 is optionally a combined lock and seal element of a metallic, heat conductive material, such as aluminum. The metallic element can be very thin and is preferably between 0.0003 inches and 0.003 inches. A lower surface of the lock and seal membrane 84 is coated with a fixant layer 86 of heat fusible material which, when subjected to heat, will soften and will fuse with the material from which the container B is made. The fixant layer 86 thereby forms the fusion joint 85 between the membrane 84 and the container's discharge spout 76. By way of example, when the container B itself is made of a polyvinylchloride or polypropylene material, the metallic membrane 84 has a lamination or layer 86 formed of material fusible with polyvinylchloride or polypropylene, respectively. The fixant layer 86 optionally covers the entire metallic membrane 84. Alternatively, the fixant layer 86 optionally covers only an annular mounting portion 87 (shown in phantom) of the metallic membrane 84 in a peripheral area expected to interface with the topmost wall of the discharge spout 76 surrounding the annular dispensing orifice 80.

As disclosed in U.S. Pat. No. 4,537,318, the laminated or layered lock and seal membrane 84 can be positioned inside of the bottle cap A and held in that position by wedging action or by the provision of separate protrusions on the inner wall surface, which are not shown. A complete closure assembly 88 including the lock and seal membrane 84 and the bottle cap A is then be threaded into closed position on the container B to press the lamination or layer 86 on the membrane 84 into tight engagement with the perimeter of the discharge spout 76 around the container dispensing orifice 80. This positioning of the closure assembly 88 is done manually or by automatic capping equipment. Thereafter, a complete package 90 (see, e.g. FIG. 22 and FIG. 23) with the container B filled with the intended liquid contents and sealed with the closure assembly 88 is moved through an induction field such as provided by known apparatus. While multiple packages 90 move continuously on a conveyor, an induction heater connected to a source of electrical energy not shown acts to heat the aluminum making up the aluminum foil disk membrane 84 to cause the softening of layer 86 of heat fusible material and the perimeter surface of the container discharge spout 76 adjacent to the dispensing orifice 80, so that the surfaces weld together. The foil disk membrane 84 serves as the heat generating member to uniformly and rapidly distribute the heat and cause softening of the heat fusible layer 86. Both the power of the induction heater and the duration of exposure of the package 90 to the field control the temperature attained by the foil membrane 84 as well as the time that it remains heated. After the package 90 passes through the induction field, cooling occurs rapidly and a permanent connection is made between the container discharge spout 76 and the combination lock and seal membrane 84. Not only is the connection permanent but it also forms an unbreakable seal between the membrane 84 and the perimeter of the container discharge spout 76.

Additionally, U.S. Pat. No. 4,719,740, Tamper Indicating Hermetic Seal, to Gach, which is incorporated in its entirety herein by reference, discloses a method of constructing or manufacturing a container closure assembly and applying it to a container to provide a hermetically sealed, tamper-indicating package, wherein the container closure includes a sealing element formed as a laminated liner disk having an inner foil layer and an outer tough thermoplastic layer. U.S. Pat. No. 4,719,740 disclose a heat sealing layer that allows the liner disk to be hermetically sealed to the container by induction heating after the closure assembly is attached to the container. U.S. Pat. No. 4,719,740 disclose that sealing a membrane to the container neck opening has become a common practice as the membrane serves the dual purpose of providing a hermetic seal and providing tamper indication by evidence of its removal or penetration.

U.S. Pat. No. 4,719,740 disclose that, where the dispensing is to take place through a special passage in the closure so that closure remains attached to the container, a recent development provides for fusion of the closure to the container at the same time that a membrane is hermetically sealed between the container and the closure over the dispensing orifice. U.S. Pat. No. 4,719,740 discloses that this recent development is shown in U.S. Pat. No. 4,537,318 to Montgomery, which is incorporated in its entirety herein by reference, in which a thin metallic foil is coated on both sides or a laminate is produced with a central metallic foil and materials on both sides which can be heat fused to the closure and the container. This laminate, in the form of a disc, is inserted into the closure cap so that when the cap is applied to the filled container, the foil can be heated by induction heating apparatus to fuse the coatings on both sides of the foil to the cap and container providing the tamper indicating hermetic seal over the dispensing orifice. Entrance to the container is obtained by piercing the thin foil, and the dispensing orifice is thereafter closed by a plug member depending from a hinged lid forming part of the closure.

U.S. Pat. No. 4,719,740 discloses that, in packaging some products, such as motor oil, it is desirable to maintain the full neck opening for dispensing the product. In such case, an aluminum foil is often glued or otherwise sealed to the lip of the container neck. For resealing purposes, a resilient material such as pulp board is inserted in the closure cap so that once the foil is torn away, the container may be resealed. Applying such a seal by the use of heat sealable layer on the metal foil and applying induction heating is shown in U.S. Pat. No. 3,460,310 to Adcok, et al., which is incorporated in its entirety herein by reference. Other laminate structures, and the method of applying them to the container are shown in U.S. Pat. No. 3,815,314 to Pollock, et al., which is incorporated in its entirety herein by reference.

U.S. Pat. No. 4,719,740 discloses that the method of producing and assembling the closure assembly includes the step of moving a continuous web of this laminate and the step of cutting a liner disk from the web to fit into the closure and sealingly engage the container. Another step is to insert the liner disk into the closure. In U.S. Pat. No. 4,719,740 a melting step is used wherein a heated tool or die is brought into contact with the laminated liner so as to melt through the sealing layer and the thermoplastic film to the metal foil forming a frangible opening line along which only the foil remains. The closure assembly is applied to the container, and the bonding is completed. U.S. Pat. No. 4,719,740 also discloses utilizing a heat sealable layer, and the bonding step includes inductively heating the foil to fuse the sealing layer to the container.

In another embodiment, U.S. Pat. No. 4,719,740 discloses the laminated liner being formed with a thermoplastic film which is bonded to one side of the foil, and the heat sealing layer is applied to the other side of the foil, wherein the melting step includes melting through the sealing layer on one side of the foil and melting through the thermoplastic film on the other side of the foil to form the frangible opening line.

U.S. Pat. No. 4,719,740 also discloses that, in some instances, either the strengthening tough polyester or thermoplastic film layer may be applied to both sides of the foil with the heat sealing coating being applied to the film on one side for bonding to the container. In U.S. Pat. No. 4,719,740 this double strengthening film layer also requires melting through the heat sealing coating and the thermoplastic film layer on both sides of the foil by bringing a heated tool in contact with the liner from both sides.

Accordingly, the permeable membrane 34 of the drink-through opening portion 12 of the closure 10, shown here in cross-section, is provided by the substantially fluid impervious film or membrane 84. The film 84 is, for example, a thin sheet or foil of metal, such as aluminum of thickness in the approximate range of about 0.0003 inch to about 0.003 inch. Alternatively, the film 84 is a thin plastic material, such as a thermoplastic. The metal or plastic film 84 is fused or otherwise sealably secured peripherally to the topmost wall of the discharge spout 76 around the dispensing orifice 80 to create a control against inadvertent flow or spillage therethrough from the beverage container B.

The film 84 is fixedly secured in place against the container's discharge spout 76. When the film 84 is plastic, especially a thermoplastic membrane, it is completely fused to the container B of thermoplastic material at the perimeter of the discharge spout 76 around the container's dispensing orifice 80, which fusing is effected by an inductive heating method as disclosed by example and without limitation in U.S. Pat. No. 3,460,310, which is incorporated in its entirety herein by reference. When the beverage container B is a thermoplastic material, the thermoplastic membrane of the film 84 is preferably the same material as the beverage container B. Fusing of the membrane 84 and the container's discharge spout 76 forms the fusion joint 85 therebetween.

When the film 84 is metal such as an aluminum foil, the metal film 84 is sealably welded or crimped on the perimeter of the discharge spout 76 around the dispensing orifice 80. By example and without limitation, the fixant layer 86 is coated on one side of the metal film 84 facing toward the dispensing orifice 80 of the discharge spout 76. The fixant layer 86 is, by example and without limitation, a layer of glue, preferably a layer of heat-sealing or thermo-adhesive, such as disclosed by example and without limitation in U.S. Pat. No. 4,228,633, which is incorporated in its entirety herein by reference. Alternatively, the fixant layer 86 is another heat sealable layer that will fuse with the bond with the metal, glass or plastic beverage container B, as disclosed by example and without limitation in U.S. Pat. No. 4,537,318, which is incorporated in its entirety herein by reference. Optionally, when the beverage container B is a thermoplastic material, the fixant layer 86 is, by example and without limitation, a layer of heat-sealing material, such as a thermoplastic film of the same material as the beverage container B.

Accordingly, whether the film 84 is the thin plastic or metal foil it is hermetically sealed to the container B. For example, when the film 84 is thermoplastic or the film 84 is coated with the fixant layer 86 of a heat fusible material, such as a thermo-adhesive or thermoplastic, the film 84 is hermetically sealed to the perimeter of the container discharge spout 76 by induction heating after the closure assembly is attached to the container B as disclosed herein.

Either before or after being hermetically sealed to the container B, the film 84 is formed with the permeable membrane 34 to form the drink-through opening portion 12 of the closure 10. For example, the thin film 84 is formed with the pattern 36 of very small individual pin prick outlet apertures or perforations 38 described herein. The pattern 36 may cover substantially the entire area of the container dispensing orifice 80, or a smaller portion thereof. If the film 84 is formed with the perforations 38 before bonding to the perimeter of the container discharge spout 76, the perforations 38 optionally cover an area of the film material larger than the container dispensing orifice 80 such that, when detached from a strip of the material, the portion forming the film 84 bonded to the container discharge spout 76 effectively contains the pattern 36 of perforations 38. Accordingly, the permeable membrane 34 forming the drink-through opening portion 12 of the closure 10 is substantially permanently sealed to the perimeter of the container discharge spout 76, whereby the pattern 36 contains a quantity of very fine perforations 38 selected to provide an aggregated throughput area sufficient for the drinker to comfortably consume therethrough the beverage in the container B with the perforations 38 being sized small enough to produce the throttle effect described herein on the of the selected liquid beverage in the container B.

The permeable membrane 34 as formed of the fused film 84 thus provides a cover over the dispensing orifice 80 to create a control against inadvertent flow or spillage therethrough from the beverage container B.

The vent 28 used with the cup lid configuration of the drink-through closure 10 is not expected to be necessary when configured for the bottle-type beverage container B having the dispensing orifice 80 formed in the narrow discharge spout 76 of the annular neck 78. Rather, when the bottle container B is formed of a flexible resilient soft plastic material, the walls may be compressed inwardly or squeezed to decrease its interior volume for assisting in the dispensing of the liquid beverage therein. Release of the squeezing force permits the resilient soft plastic to expand and draw replacement air in through the two-way perforations 38, whereby the need for the separate vent 28 is overcome. When instead the bottle container B is hard sided, e.g. glass or metal, the container B operates substantially the same as having a conventional unthrottled dispensing orifice 80, i.e. the discharge spout 76 must be periodically cleared of liquid whereupon the two-way perforations operate in reverse and permit air to enter the container B for replacing the discharged liquid beverage and equalizing pressure with the outside ambient atmosphere.

Optionally, a protective tape seal 92 may be installed over the permeable membrane 34 in the area containing the pattern 36 of perforations 38 forming the drink-through opening portion 12 of the closure 10. The tape seal 92 may optionally extend over substantially more than the area containing the drink-through opening 12, and may optionally cover an entire upper or outside surface 94 of the closure 10 external of the beverage container B. The tape seal 92 is hygienic and provides a tamper indicator that may be desirable. Optionally, the tape seal 92 includes a tab 92*a* that is free of adhesive for ease in removal, as illustrated here in phantom.

Figure 22:
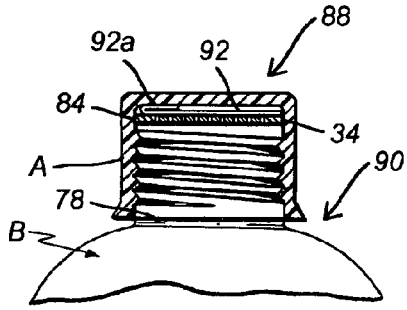
FIG. 22 illustrates by example and without limitation the novel drink-through closure configured for a bottle-type personal beverage container wherein the permeable membrane of the drink-through opening portion is embodied by example and without limitation as the thin metal or plastic film that is permanently secured to the perimeter of a discharge spout of the container and closes a dispensing orifice thereof to prevent the liquid therein from being poured from the container when the container is tilted.

FIG. 22 illustrates the drink-through closure 10 configured for a bottle-type personal beverage container B wherein the permeable membrane 34 of the drink-through opening portion 12 is embodied by example and without limitation as the thin metal or plastic film 84 that is permanently secured to the perimeter of the discharge spout 76 of the container B and closes the dispensing orifice 80 to prevent the liquid therein from being poured from the container B when the container B is tilted. Here, the bottle cap A (shown in cross-section) of the closure assembly 88 is threaded or otherwise affixed to the container discharge spout 76 over the dispensing orifice 80 and the sealed drink-through closure 10 for forming the complete package 90 when the container B contains the intended liquid contents. The optional tab 92*a* of the optional tape seal 92 is folded over the dispensing orifice 80 to avoid interference with the bottle cap A.

Figure 23:
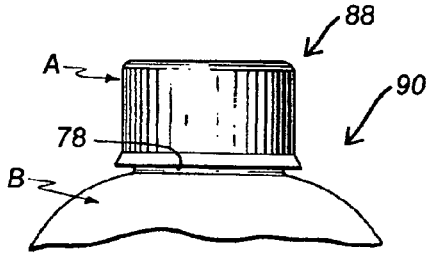
FIG. 23 illustrates a complete package having the bottle-type personal beverage container containing the intended liquid contents and sealed with a novel drink-through closure assembly including the novel drink-through closure and a conventional closed-end bottle cap configured to mate with the bottle-type personal beverage container.

FIG. 23 illustrates the complete package 90 having the bottle-type personal beverage container B containing the intended liquid contents and sealed with the closure assembly 88. As illustrated here, only the bottle-type personal beverage container B and bottle cap A are visible. Accordingly, the sealed drink-through closure 10 does not substantially change the outline or function of the container discharge spout 76 so that the complete package 90 substantially resembles the package of the prior art. The same prior art bottle container B and mating bottle cap A are utilized.

Figure 24:
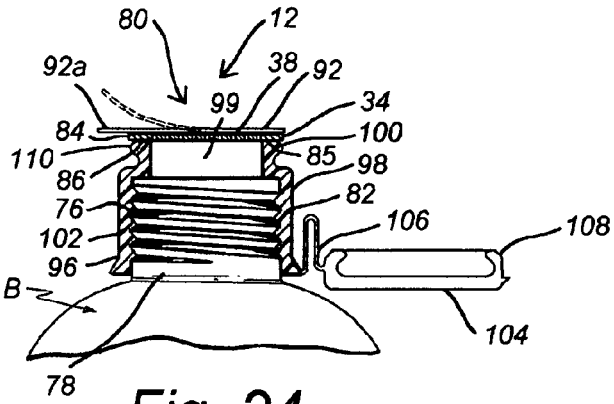
FIG. 24 illustrates by example and without limitation the novel drink-through closure for a personal beverage container embodied by example and without limitation as another configuration of splash resistant closure affixed to a bottle-type personal beverage container, wherein an internally threaded drink-through bottle cap is substituted for the conventional closed-end bottle cap.

FIG. 24 illustrates the drink-through closure 10 for a personal beverage container embodied by example and without limitation as another configuration of splash resistant closure affixed to a bottle-type personal beverage container B. Here, an internally threaded drink-through bottle cap 96 is substituted for the closed-end bottle cap A. However, the configuration of the drink-through closure 10 illustrated in FIG. 20, FIG. 21 and FIG. 22 is optionally utilized with the drink-through bottle cap 96 illustrated here. For example, the drink-through bottle cap 96 is illustrated here as being formed with a substantially cylindrical body 98 having a tubular aperture 99 formed therethrough. The tubular aperture 99 is about the same size as the dispensing orifice 80 of the beverage container B and is substantially aligned therewith.

The drink-through opening 12 is provided adjacent to one end of the bottle cap's body 98 surrounded by a peripheral lip 100 of the tubular aperture 99. The drink-through opening 12 is thus substantially aligned with the dispensing orifice 80 of the beverage container B and is optionally slightly spaced there above, the drink-through opening 12 being about the same size as the container's dispensing orifice 80.

The drink-through bottle cap 96 illustrated here is retained on the discharge spout 76 of the container B adjacent to dispensing orifice 80, for example by engagement with the external threads 82 or by an other means for retaining the drink-through bottle cap 96 on the container discharge spout 76. For example, the substantially cylindrical body 98 of the drink-through bottle cap 96 is illustrated here as being formed with internal threads 102 substantially matched to the container's external threads 82. Alternatively, the drink-through bottle cap 96 is a crimp-on type bottle cap, and the means for retaining the drink-through bottle cap 96 adjacent to the discharge spout 76 of the container B is a crimp formed in the body 98 of the bottle cap 96 capturing a lip on the container discharge spout 76 peripheral of the dispensing orifice 80. Such variations in the bottle cap retaining means are also contemplated and may be substituted without deviating from the scope and intent of the present invention.

The drink-through opening portion 12 of the drink-through bottle cap closure 10 includes the permeable membrane 34 formed of the otherwise substantially fluid impervious plastic or metal film 84 having the pattern 36 of very small individual pin prick outlet apertures or perforations 38 described herein. As discussed herein, the size, shape and quantity of perforations 38 are selected as a function of both the viscosity and surface tension of the liquid in the beverage bottle B to produce the throttle effect described herein.

The film 84 is fixedly secured in place against the peripheral lip 100 of the drink-through opening 12 and substantially covering the container's discharge spout 76 by formation of the fusion joint 85 therebetween. For example, the metal or plastic film 84 is fused or otherwise sealably secured peripherally to the peripheral lip 100 around the drink-through opening 12 to create a throttle control against inadvertent flow or spillage therethrough from the beverage container B. Furthermore, the film 84 is of such strength that, when the container B is inverted, the seal will remain intact even under the weight of the container's contents.

When both the drink-through bottle cap 96 and the film 84 are plastic, especially the same thermoplastic, the fusion joint 85 completely fuses the plastic film 84 to the peripheral lip 100 at the perimeter of the drink-through opening 12, which fusing is effected by an inductive heating method as discussed herein.

When the film 84 is metal such as an aluminum foil, the metal film 84 is sealably welded or crimped on the drink-through opening 12 of the drink-through bottle cap 96 around the peripheral lip 100. By example and without limitation, the fixant layer 86 is coated on one side of the metal film 84 facing toward the drink-through opening 12 of the bottle cap 96. The fixant layer 86 is, by example and without limitation, a layer of glue, preferably a layer of heat-sealing or thermo-adhesive, such as disclosed by example and without limitation in U.S. Pat. No. 4,228,633, which is incorporated in its entirety herein by reference. Alternatively, the fixant layer 86 is another heat sealable layer that will form the fusion joint 85 for fusing the metal film 84 with the of the bottle cap 96. Optionally, when the bottle cap 96 is a thermoplastic material, the fixant layer 86 is, by example and without limitation, a layer of heat-sealing material, such as a thermoplastic film of the same material as the bottle cap 96.

The drink-through bottle cap 96 illustrated here includes an optional secondary resealable lid 104 which may be tethered to the main bottle cap 96 by a flexible hinge member 106, illustrated here by example and without limitation as a repeatably bendable tether. When present, a latch or other releasable retaining mechanism 108, 110 is provided between the optional secondary resealable lid 104 and the peripheral lip 100 of the drink-through opening 12 portion of the drink-through bottle cap 96 to uncover the container's dispensing orifice 80. See, e.g. FIG. 26.

When present, the optional tape seal 92 is installed over the permeable membrane 34 in the area containing the pattern 36 of perforations 38 forming the drink-through opening portion 12 of the closure 10. Optionally, the tape seal 92 includes the tab 92*a* that is free of adhesive for ease in removal, as illustrated here in phantom.

The film 84 is optionally formed during formation of the drink-through bottle cap 96 and integral therewith.

Figure 25:
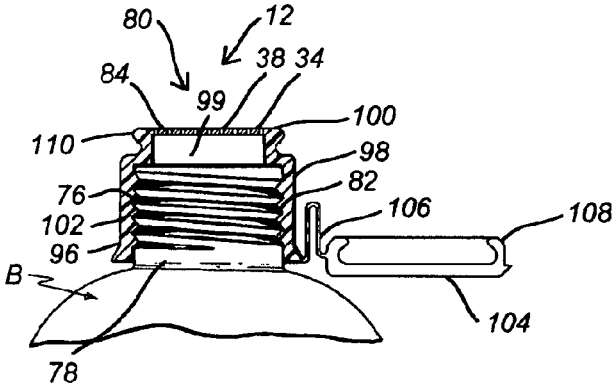
FIG. 25 illustrates by example and without limitation another configuration of the novel drink-through closure for a personal beverage container embodied by example and without limitation as another configuration of splash resistant closure affixed to a bottle-type personal beverage container, wherein the film providing the drink-through opening portion of the novel closure is optionally formed during formation of the drink-through bottle cap and integral therewith.

FIG. 25 illustrates another configuration of the drink-through closure 10 for a personal beverage container embodied by example and without limitation as another configuration of splash resistant closure affixed to a bottle-type personal beverage container B. Here, the film 84 providing the drink-through opening portion 12 of the closure 10 is optionally formed during formation of the drink-through bottle cap 96 and integral therewith. The film 84 is formed adjacent to the peripheral lip 100 of the bottle cap 96 around the drink-through opening 12 and spaced above the dispensing orifice 80 of the beverage container B. Furthermore, the film 84 is of such strength that, when the container B is inverted, the seal will remain intact even under the weight of the container's contents. The pattern 36 of very small individual pin prick outlet apertures or perforations 38 are provided in the otherwise substantially fluid impervious film or membrane 84 either during formation of the bottle cap 96, or in a secondary operation.

The optional tape seal 92 (shown in FIG. 24) is optionally installed over the permeable membrane 34 in the area containing the pattern 36 of perforations 38 forming the drink-through opening portion 12 of the closure 10. Optionally, the tape seal 92 includes the tab 92*a* that is free of adhesive for ease in removal, as illustrated here in phantom.

Figure 26:
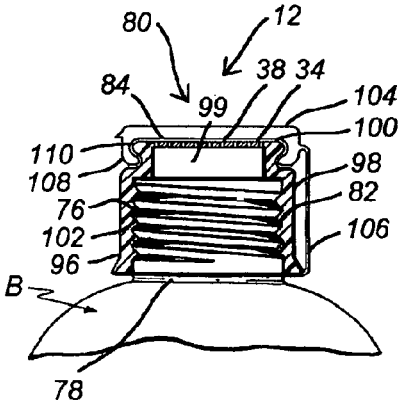
FIG. 26 illustrates by example and without limitation another configuration of the novel drink-through closure for a personal beverage container embodied as the splash resistant drink-through bottle cap affixed to a bottle-type personal beverage container, wherein the optional secondary resealable lid is shown in a CLOSED position over the drink-through opening and the container's dispensing orifice with a latch or other releasable retaining mechanism being engaged between the optional secondary resealable lid and a peripheral lip of the drink-through opening portion of the drink-through bottle cap.

FIG. 26 illustrates another configuration of the drink-through closure 10 for a personal beverage container embodied as the splash resistant drink-through bottle cap 96 affixed to a bottle-type personal beverage container B. Here, the optional secondary resealable lid 104 is shown in a CLOSED position over the drink-through opening 12 and the container's dispensing orifice 80. The latch or other releasable retaining mechanism 108, 110 is shown engaged between the optional secondary resealable lid 104 and the peripheral lip 100 of the drink-through opening 12 portion of the drink-through bottle cap 96 for providing the complete package 90.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A disposable lid closure for mounting upon a substantially circular lip of a personal beverage drinking cup, the lid comprising:

an annular mounting portion comprising means for anchoring upon the circular drinking cup lip;

a top plate portion coupled to the annular mounting portion;

a drink-through opening within the top plate portion and adjacent to an outer portion thereof adjacent to the annular mounting portion and enabling drinking from the cup without removal of the lid and permitting lips of a user drinking from the cup to substantially encompass the drink-through opening, the drink-through opening further comprising a porous membrane permeable to a water-based liquid and comprising a substantially self-supporting mesh material comprising a pattern of perforations; and a vent opening within the top plate portion spaced away from the drink-through opening.

2. The lid closure of claim 1 wherein the pattern of perforations of the mesh material of the drink-through opening further comprises a plurality of apertures having an average area substantially in the range of about 0.05 to about 0.12 square millimeters.

3. The lid closure of claim 1 wherein the pattern of perforations of the mesh material of the drink-through opening further comprises a plurality of apertures having an average area substantially in the range of about 0.08 to about 0.10 square millimeters.

4. The lid closure of claim 1 wherein the vent opening further comprises a plurality of perforations.

5. The lid closure of claim 4 wherein the membrane of the drink-through opening further comprises a surface being substantially flush with a surrounding portion of the top plate portion; and the membrane of the vent opening further comprises a surface being substantially flush with a surrounding portion of the top plate portion.

6. The lid closure of claim 5, further comprising an annular outer sidewall portion sloping upwardly and radially inwardly from the annular mounting portion and being coupled to the top plate portion.

7. The lid closure of claim 5, further comprising: an annular outer sidewall portion sloping upwardly and radially inwardly from the annular mounting portion; and the top plate portion further comprising:

an annular top wall portion formed adjacent to a top of the outer sidewall portion spaced above the annular mounting portion, an annular inner sidewall portion projected downwardly of the annular top wall portion, an inner top plate portion being formed within the annular inner sidewall portion and spaced away from the annular top wall portion;

a recessed portion within the inner top plate portion, the recessed portion further comprising an arcuate sidewall portion adjacent to the drink-through opening and an interior side wall spaced away from the drink-through opening and terminating in the inner top plate portion, and a drain hole formed in the recessed portion and spaced away from the inner top plate portion.

8. The lid closure of claim 1 wherein at least the mesh material of the liquid permeable membrane of the drink-through opening further comprises a discrete membrane coupled to an aperture formed through the top plate portion.

9. A lid closure for mounting upon a lip of a personal drinking cup, the lid closure comprising:

a top plate portion surrounded by a mounting portion that anchors upon the lip;

a drink-through opening within the top plate portion and adjacent to the mounting portion enabling drinking from the cup without removal of the lid and permitting lips of a user drinking from the cup to encompass the drink-through opening, the drink-through opening further comprising a liquid permeable membrane formed of a substantially self-supporting liquid permeable mesh comprising a plurality of perforations; and a vent opening within the top plate portion adjacent to the mounting portion substantially opposite from the drink-through opening, the vent opening further comprising an air permeable membrane.

10. The lid closure of claim 9 wherein one or more of the plurality of perforations further comprises an aperture having a area substantially in the range of about 0.05 to about 0.12 square millimeters.

11. The lid closure of claim 9 wherein one or more of the plurality of perforations further comprises an aperture having a area substantially limited to the range of about 0.08 to about 0.10 square millimeters.

12. A lid closure for mounting upon a lip of a personal drinking cup, the lid closure comprising:

a top plate portion surrounded by a mounting portion that anchors upon the lip;

a drink-through opening within the top plate portion and adjacent to the mounting portion enabling drinking from the cup without removal of the lid and permitting lips of a user drinking from the cup to encompass the drink-through opening, the drink-through opening further comprising a liquid permeable membrane formed of a substantially self-supporting liquid permeable mesh comprising a pattern of elongated slit perforations of about 0.12 millimeters or less in width.

13. The lid closure of claim 9 wherein the liquid permeable membrane of the drink-through opening further comprises a discrete portion of self-supporting mesh material.

14. The lid closure of claim 13 wherein the discrete portion of self-supporting mesh material of the liquid permeable membrane of at least the drink-through opening further comprises a discrete membrane coupled to an aperture formed through the top plate portion.

15. The lid closure of claim 9 wherein the liquid permeable membrane of the drink-through opening further comprises a surface substantially flush with the top plate portion; and the air permeable membrane of the vent opening further comprises a surface substantially flush with the top plate portion.

16. The lid closure of claim 9, further comprising a peripheral outer sidewall portion projected upwardly from the mounting portion; and wherein the top plate portion further comprises a primary recessed portion therein and interior of the drink-through opening, the primary recessed portion further comprising an sidewall portion adjacent to the drink-through opening and a drain hole formed therein.

17. The lid closure of claim 16 wherein the top plate portion further comprises a peripheral top wall portion formed adjacent to the outer sidewall portion spaced away from the mounting portion, the peripheral top wall portion substantially containing the drink-through opening; and an inner top plate portion within the peripheral top wall portion, the inner top plate portion substantially containing the vent opening.

18. A disposable dome lid closure for mounting upon a substantially circular lip of a disposable drinking cup, the lid closure comprising:

an annular mounting portion that anchors upon the circular cup lip;

an annular outer sidewall portion sloping upwardly and radially inwardly from the mounting portion thereby providing volume extension means within the lid;

an annular top wall portion formed at the top of the outer sidewall portion enclosing the top of the outer sidewall portion;

an inner top plate portion within the annular top wall portion;

a drink-through opening within the annular top wall portion and adjacent to the outer sidewall portion enabling drinking from the cup without removal of the lid and permitting lips of a user drinking from the cup to encompass the drink-through opening, with the lower lip of the user engaging with the outer sidewall portion, the drink-through opening further comprising a mesh membrane comprising a portion of substantially self-supporting mesh material comprising a plurality of perforations whereby the membrane is permeable to water-based liquid;

a primary recessed portion within the inner top plate portion providing clearance for the upper lip of the user, wherein the primary recess includes an arcuate sidewall portion adjacent to the drink-through opening with the upper lip of the user engaging with the arcuate sidewall portion;

a drain hole formed in the primary recess and being substantially larger than the perforations of the mesh membrane; and a vent opening within the inner top plate portion adjacent to the annular top wall portion substantially opposite from the drink-through opening, the vent opening further comprising an air permeable membrane.

19. The lid closure of claim 18 wherein at least the perforations of the mesh membrane of the drink-through opening further comprises a pattern of a plurality of the perforations, and wherein each of the perforations further comprises an average area substantially in the range of about 0.05 to about 0.12 square millimeters.

20. The lid closure of claim 19 wherein the plurality of perforations further comprises substantially discrete perforations each having an average area substantially limited to the range of about 0.08 to about 0.10 square millimeters.

21. The lid closure of claim 19 wherein the liquid permeable membrane of the drink-through opening further comprises a surface substantially flush with the annular top wall portion; and the air permeable membrane of the vent opening further comprises a surface substantially flush with the inner top plate portion.

22. The lid closure of claim 18 wherein the portion of substantially self-supporting mesh material of the liquid permeable membrane of the drink-through opening further comprises a discrete portion of substantially self-supporting mesh material.

23. The lid closure of claim 18 wherein the liquid permeable membrane of at least the drink-through opening further comprises a discrete membrane coupled to an aperture formed through the annular top wall portion.

24. The lid closure of claim 23 wherein the air permeable membrane of the vent opening further comprises a discrete membrane coupled to an aperture formed through the inner top plate portion.

25. A method for forming a disposable lid closure for mounting upon the lip of a personal beverage container, the method comprising:

in a plastic material, forming a thin top plate portion;

in the plastic material, forming a thin peripheral mounting portion coupled to the top plate portion and further comprising means for anchoring upon the container lip;

in the plastic material, forming a drink-through opening within the top plate portion and adjacent to an outer portion thereof adjacent to the peripheral mounting portion, the forming the drink-through opening further comprising forming a first membrane of substantially self-supporting mesh material and being substantially permeable to water-based liquids; and in the plastic material, forming a vent opening within the top plate portion spaced away from the drink-through opening, the forming the vent opening further comprising forming a second membrane substantially permeable to air.

26. The method of claim 25 wherein the forming the first membrane of the drink-through opening further comprises forming a plurality of perforations.

27. The method of claim 26 wherein the forming the plurality of perforations of the drink-through opening as a plurality of perforations further comprises forming the plurality of perforations having an average area substantially in the range of about 0.05 to about 0.12 square millimeters.

28. The method of claim 25 wherein the forming the liquid permeable membrane of the drink-through opening further comprises forming a plurality of perforations sized as a function of at least one of a range of viscosity and a range of surface tension of a water-based liquid in such manner as to produce a throttle effect on the water-based liquids.

29. The method of claim 28 wherein the forming the respective liquid and air permeable membranes further comprises forming each of the liquid and air permeable membranes as respective first and second pluralities of perforations each having a substantially identical average range of pore sizes.

30. The method of claim 28 wherein the forming a first plurality of perforations further comprises forming the first plurality of perforations having a first average range of pore sizes, and the forming a second plurality of perforations further comprises forming the second plurality of perforations having a second average range of pore sizes substantially smaller than the first average range of pore sizes.

31. The method of claim 25 wherein the forming the first and second permeable membranes further comprises forming the first and second porous permeable membranes substantially flush with an outer surface of the top plate portion.

32. The method of claim 25, further comprising, in the plastic material, forming a thin peripheral outer sidewall portion sloping upwardly and radially inwardly from the peripheral mounting portion and being coupled to the top plate portion.

33. The method of claim 25, wherein the forming the top plate portion further comprises:

in the plastic material, forming a peripheral top wall portion adjacent to a top of the outer sidewall portion spaced above the peripheral mounting portion;

in the plastic material, forming a peripheral inner sidewall portion projected downwardly of the peripheral top wall portion;

in the plastic material, forming an inner top plate portion within the peripheral inner sidewall portion and spaced away from the peripheral top wall portion;

in the plastic material, forming a recessed portion within the inner top plate portion, forming the recessed portion further comprising forming a sidewall portion adjacent to the drink-through opening and an interior side wall spaced away from the drink-through opening and terminating in the inner top plate portion; and in a distal portion of the recessed portion of the inner top plate portion, forming a drain hole in the plastic material.

34. The method of claim 25 wherein the first liquid permeable membrane of the drink-through opening further comprises forming a plurality of elongated slit perforations.

35. The method of claim 25 wherein the forming a drink-through opening within the top plate portion further comprises forming an enlarged aperture through the top plate portion, and mounting therein a discrete liquid permeable membrane.

36. The method of claim 35 wherein the forming a vent opening within the top plate portion further comprises forming an enlarged aperture through the top plate portion, and mounting therein a discrete air permeable membrane.

37. A drink-through closure for mounting upon the substantially circular lip of a personal beverage container further comprising a narrow discharge spout comprising a thick annular neck forming a dispensing orifice communicating with an interior portion of the container; said drink-though closure comprising a substantially fluid impervious membrane of substantially self-supporting mesh material, further comprising a drink-through opening portion thereof comprising a plurality of perforations rendering the drink-through opening portion permeable to a water-based liquid, and an annular mounting portion impermeably coupled to a peripheral portion of the discharge spout surrounding the dispensing orifice.

38. The closure of claim 37 wherein the plurality of perforations of the drink-through opening portion further comprises a plurality of perforations sized as a function of at least one of a range of viscosity and a range of surface tension of a water-based liquid in such manner as to produce a throttle effect on a water-based liquid.

39. The closure of claim 37 wherein the plurality of perforations of the drink-through opening portion further comprises a plurality of perforations each further comprising an aperture having an area substantially in the range of about 0.05 to about 0.10 square millimeters.

40. The closure of claim 39, further comprising a fusion joint formed between the annular mounting portion of the drink-through closure and the peripheral portion of the discharge spout.

41. The closure of claim 40 wherein the membrane of the drink-through closure further comprises a metallic foil coated with a fixant layer at least in the annular mounting portion thereof, the fusion joint being formed between the fixant layer and the peripheral portion of the discharge spout.

42. The closure of claim 41 wherein the fixant layer further comprises a heat fusible material.

43. The closure of claim 40 wherein the membrane of the drink-through closure further comprises a heat fusible thermoplastic material.

44. A drink-through bottle cap closure structured to attach to a discharge spout of a bottle adjacent to a dispensing orifice thereof communicating with an interior portion of the container, the drink-through bottle cap closure comprising: a substantially cylindrical body comprising a tubular aperture thereof extending substantially completely therethrough and surrounded by a peripheral lip adjacent to one end thereof; a substantially fluid impervious membrane of substantially self-supporting mesh material having an annular mounting portion impermeably coupled to the peripheral lip of the body surrounding the tubular aperture thereof, and further comprising a drink-through opening portion thereof comprising a plurality of perforations rendering the drink-through opening portion of the membrane permeable to a water-based liquid; and a means for retaining the drink-through bottle cap on the container discharge spout.

45. The closure of claim 44 wherein the plurality of perforations of the drink-through opening portion further comprises a plurality of perforations sized as a function of at least one of a range of viscosity and a range of surface tension of a water-based liquid in such manner as to produce a throttle effect on a water-based liquid.

46. The closure of claim 45 wherein the plurality of perforations of the drink-through opening portion further comprises a plurality of perforations each further comprising an aperture having an area substantially in the range of about 0.05 to about 0.10 square millimeters.

47. The closure of claim 45, further comprising a fusion joint formed between the annular mounting portion of the membrane and the peripheral lip of the body surrounding the tubular aperture thereof.

48. The closure of claim 47 wherein the membrane further comprises a metallic foil coated with a fixant layer at least in the annular mounting portion thereof, the fusion joint being formed between the fixant layer and the peripheral lip of the body.

49. The closure of claim 48 wherein each of the body and the fixant layer further comprises a heat fusible material.

50. The closure of claim 47 wherein each of the body and the membrane further comprises a heat fusible thermoplastic material.

* * * * *